US009366988B2

(12) United States Patent
Kubo et al.

(10) Patent No.: US 9,366,988 B2
(45) Date of Patent: Jun. 14, 2016

(54) DEVELOPING DEVICE AND IMAGE FORMING APPARATUS

(71) Applicant: CANON KABUSHIKI KAISHA, Tokyo (JP)

(72) Inventors: Kenta Kubo, Kamakura (JP); Hideaki Okamoto, Yokohama (JP); Satoru Yamanaka, Kawasaki (JP); Tatsuya Tada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/597,313

(22) Filed: Jan. 15, 2015

(65) Prior Publication Data

US 2015/0227077 A1 Aug. 13, 2015

(30) Foreign Application Priority Data

Feb. 12, 2014 (JP) ..... 2014-024650

(51) Int. Cl.
*G03G 15/08* (2006.01)
*G03G 15/09* (2006.01)

(52) U.S. Cl.
CPC ..... *G03G 15/0818* (2013.01); *G03G 15/0921* (2013.01)

(58) Field of Classification Search
CPC ..... G03G 15/0921; G03G 15/0928; G03G 15/0942; G03G 15/0907; G03G 15/09
See application file for complete search history.

(56) References Cited

U.S. PATENT DOCUMENTS

| | | | | |
|---|---|---|---|---|
| 5,153,376 | A * | 10/1992 | Tomita | 399/276 |
| 2003/0170050 | A1* | 9/2003 | Terai | 399/267 |
| 2007/0177908 | A1* | 8/2007 | Aruga et al. | 399/286 |
| 2008/0080905 | A1* | 4/2008 | Hirota et al. | 399/270 |

(Continued)

FOREIGN PATENT DOCUMENTS

| | | | |
|---|---|---|---|
| JP | H09-211970 | A | 8/1997 |
| JP | H10-198161 | A | 7/1998 |

(Continued)

OTHER PUBLICATIONS

Kenta Kubo et al., U.S. Appl. No. 14/612,531, filed Feb. 3, 2015.
Kenta Kubo et al., U.S. Appl. No. 14/613,608, filed Feb. 4, 2015.

*Primary Examiner* — David Gray
*Assistant Examiner* — Sevan A Aydin
(74) *Attorney, Agent, or Firm* — Fitzpatrick, Cella, Harper & Scinto

(57) ABSTRACT

A developing device configured to develop an electrostatic image includes a developing member and a carrier recovering member. An outer surface of the developing member includes a plurality of protrusion portions which extend in a direction intersecting a toner particle carrying direction and are aligned with a regular interval between adjacent protrusion portions. The regular interval is equal to or larger than a particle diameter of a toner particle having an average particle diameter from among the toner particles and smaller than a carrier particle diameter of a magnetic carrier particle having an average particle diameter from among the magnetic carrier particles. The protrusion portions protrude from the outer surface of the developing member with a height that is smaller than the average particle diameter of the toner particles, and the developing member contacts with the image bearing member at a developing portion.

12 Claims, 27 Drawing Sheets

(56) References Cited

U.S. PATENT DOCUMENTS

2014/0023408 A1* 1/2014 Kato et al. ..... 399/269
2014/0161493 A1* 6/2014 Kubo et al. ..... 399/272

FOREIGN PATENT DOCUMENTS

JP 2004020581 A * 1/2004 ..... G03G 15/08
JP 2009-008834 A 1/2009

* cited by examiner

ROTATIONAL DIRECTION OF TONER BEARING MEMBER

DEVELOPING DEVICE AND IMAGE FORMING APPARATUS

BACKGROUND OF THE INVENTION

1. Field of the Invention

The present invention relates to an image forming apparatus such as a copying machine, a printer, or a fax machine using an electrophotographic system, and a developing device used therein.

2. Description of the Related Art

A dry developing method applied to an electrophotographic system includes a one-component developing method using only a toner and a two-component developing method using a developer including a toner and a magnetic carrier.

Since the one-component developing method does not include a magnetic carrier, an electrostatic image of an image bearing member is not disturbed by a magnetic brush formed of a magnetic carrier, but is suitable for enhancing an image quality. However, since the one-component developing method cannot stably impart a charge to the toner, the one-component developing method has a problem in stability of an image quality. Furthermore, since the one-component developing method does not include a medium for carrying a toner, like a magnetic carrier, the one-component developing method cannot impart a uniform carrying force to the toner, and a mechanical load to the toner may be easily increased when the toner is carried. Thus, the stability of the image quality may be easily reduced by deterioration of the toner.

On the other hand, although the two-component developing method has a problem in image quality, the two-component developing method may easily impart a charge to a toner. Furthermore, since a load to the toner is small, the stability of an image quality is high.

As a method for solving the problems of the above-described developing methods, a hybrid developing method is disclosed in Japanese Patent Laid-Open No. 9-211970. The hybrid developing method applies a carrying bias between a carrying roller (developer bearing member) for carrying a two-component developer and a developing roller (toner bearing member), covers the developing roller with a toner layer, and develops an electrostatic image of a photoreceptor (image bearing member) using the toner layer, thereby forming an image.

However, it is known that the hybrid developing method cannot stably cover the developing roller with a toner layer over a long period. The hybrid developing method covers the developing roller with a toner having a predetermined charge quantity Q/S, in order to bridge a potential difference ΔV which is generated between the carrying roller and the developing roller by the above-described carrying bias. At this time, the potential difference ΔV and the charge quantity Q/S of the toner per unit area to be covered are proportional to each other. Furthermore, the charge quantity Q/S corresponds to a product of the mass of toner related to covering per unit area (M/S) and a charge quantity of the toner per unit mass (Q/M). Thus, the following equation is established:

$$\Delta V \propto Q/S = (M/S) \times (Q/M) \qquad \text{Equation (1)}$$

That is, in the hybrid developing method, the mass M/S of the toner related to covering per unit area is determined from the potential difference ΔV and the charge quantity Q/M of the toner per unit mass. Thus, the hybrid developing method has a problem in that, when the charging amount of the toner is changed, a toner amount related to covering is varied according to the change in charging amount of the toner.

In order to solve such a problem, Japanese Patent Laid-Open No. 2009-8834 discloses a method for measuring the thickness of a toner layer on a developing roller using a toner layer thickness sensing member, when covering the developing roller with a toner layer. Furthermore, Japanese Patent Laid-Open No. 2009-8834 also discloses a method for controlling the thickness of the toner layer on the developing roller to a predetermined thickness by changing a carrying bias between the developing roller and the magnetic roller (developer bearing member) or the rotation numbers of the developing roller and the magnetic roller, based on the thickness of the toner layer.

However, since the method uses a toner density sensor or surface potential sensor as the toner layer thickness sensing member, the method may increase the size of a device or the cost. Furthermore, when the carrying bias or the rotation number of the developing roller is changed even in case where the thickness of the toner layer is controlled through the sensing member, a development condition between the photoreceptor and the developing roller in the downstream needs to be controlled at the same time. Thus, the control operation becomes complex. As a result, the method cannot accomplish the original goal that is stabilizing the toner mount on the photoreceptor.

As a developing method for stably forming a toner layer, Japanese Patent Laid-Open No. 10-198161 discloses a developing device using a rotatable regulating sleeve (developer regulating member) arranged at a predetermined interval from the developing roller. The developing device can stably impart a charge to a toner through a carrier, and cover a developing roller with a toner layer while preventing reduction in the density of an output image or occurrence of toner scattering. The developing device 320 is provided with a developing container 321 which contains a developer 310 including a toner and a magnetic carrier.

Hereinafter, the developing device 320 will be described with reference to FIG. 22.

The developing container 321 formed at a position facing a photoreceptor 301 has an opening in which a developing roller 322 and a developer collection member 323 are arranged. The developing roller 322 can be rotated in an arrow direction of FIG. 22, and the developer collection member 323 is positioned above the developing roller 322, with a predetermined interval provided therebetween. The developer collection member 323 includes a regulating sleeve 331 formed of a nonmagnetic material and a permanent magnet 332 fixed and arranged therein. The regulating sleeve 331 is rotatably supported in the same direction as the rotational direction (arrow direction of FIG. 22) of the developing roller 322. Furthermore, the developing container 321 includes a carrying member 324 which stirs a developer within the developing container 321 and supplies the developer to the developing roller 322, while rotating in the arrow direction of FIG. 22.

Next, a process of covering the developing roller 322 with a toner layer in the developing device 320 will be described.

The developer 310 within the developing container 321 is stirred by the carrying member 324 and supplied onto the developing roller 322. The supplied developer 310 is borne and carried onto the developing roller 322 magnetized by receiving a magnetic force of the permanent magnet 332 within the regulating sleeve 331, and regulated in a developer regulation region G.

FIG. 23 is an enlarged view of the developer regulation region G.

The magnetic carrier within the developer restrained by a magnetic field in the developer regulation region G is restrained by the magnetic force of the permanent magnet 332. Since the regulating sleeve 331 is rotated in an arrow direction of FIG. 23, the magnetic carrier receives a carrying force in a direction A of FIG. 23, in which the magnetic carrier is returned into the developing container 321, according to the rotation. Thus, while the magnetic carrier is restrained in the developer regulation region G, the magnetic carrier is sequentially returned into the developing container 321 by the carrying force from the regulating sleeve 331. Thus, the magnetic carrier does not leak to a developing portion facing the photoreceptor 301.

On the other hand, a nonmagnetic toner 311 within the developer in the developer regulation region G is not restrained by the magnetic field in the developer regulation region G. Furthermore, the nonmagnetic toner 311 adheres to the developing roller 322 due to a reflection force caused by a charge imparted through frictional charging between the magnetic carrier and the surface of the developing roller 322. Thus, the nonmagnetic toner 311 receives a carrying force in the rotational direction of the developing roller 322 (direction B of FIG. 23) according to the rotation of the developing roller 322, and passes through the developer within the developer regulation region G so as to cover the developing roller 322.

As described above, the magnetic carrier can cover the developing roller 322 only with the nonmagnetic toner to which a sufficient amount of charge is imparted, without leaking to the developing portion. The developing device disclosed in Japanese Patent Laid-Open 10-198161 uses a force acting on the toner which can be physically contacted with the developing roller. Thus, the developing device may prevent a phenomenon which is seen in the hybrid developing method, that is, a rapid variation in the toner amount related to covering due to a variation in charge quantity Q/M of the toner.

When the charge quantity of the toner is reduced, the hybrid developing method increases the toner amount related to covering. However, the developing device disclosed in Japanese Patent Laid-Open 10-198161 can suppress a variation in image density, which increases the toner amount, because the increase in toner amount related to covering is suppressed.

However, according to a detailed examination of the present inventor, the image uniformity of the developing device disclosed in Japanese Patent Laid-Open 10-198161 needs to be further improved, while a variation of image density is further suppressed.

FIG. 24 is a conceptual view of a toner layer which is obtained by the developing device 320 so as to cover the developing roller. In FIG. 24, a black portion indicates a part of the toner layer covering the developing roller, and a white portion indicates a region which is not covered with the toner layer. As illustrated in FIG. 24, regions which are not covered with the toner layer irregularly exist substantially in parallel to the rotational direction of the developing roller, and the density of the toner on the developing roller is not uniform. As such, when the covering layer of toner on the developing roller is non-uniformly formed, the image density may be easily reduced. That is because the area of white portions on a sheet, which are not covered with the toner, is increased during fixation and the image density is rapidly reduced.

The image density can be increased by adjusting the circumferential velocity of the developing roller and the photoreceptor and excessively supplying toner onto the photoreceptor. Specifically, the image density can be increased by further raising the circumferential velocity of the developing roller than the photoreceptor, when the developing roller and the photoreceptor are rotated in the same direction at facing portions thereof. Alternatively, the image density can be increased by setting the rotational directions of the developing roller and the photoreceptor to the opposite direction at the facing portions thereof. However, although a desired image density is obtained, in-plane density unevenness stands out as illustrated in FIG. 25B. In this case, an image having low image uniformity is inevitably obtained. Furthermore, from the viewpoint of reduction in energy consumption, the toner may be consumed more than necessary, while a desired image is required to be outputted at a smaller toner amount.

FIG. 25A is a schematic view illustrating a case in which an electrostatic image on the photoreceptor is ideally developed through a toner. FIG. 25B is a schematic view illustrating a case in which an image density is obtained through the above-described method.

Referring to FIG. 25A, a toner image having a high level of uniformity is obtained at a small toner amount. On the other hand, referring to FIG. 25B, however, a toner image having a low level of uniformity is obtained at large toner amount.

As the result of the detailed examination of the present inventor, the reason of such phenomenon can be described using the following model. This will be described with reference to FIG. 26.

FIG. 26 illustrates that the developer 310 carried in the rotational direction h of the developing roller 322 in the developer regulation region G forms magnetic brushes due to the magnetic field, and is restrained by the developer collection member 323 and carried in the rotational direction j of the developer collection member 323. In reality, a plurality of developers (not illustrated) exists as magnetic brushes.

While the developer 310 is carried over the developing roller 322, the toner 311 of the developer 310 is charged by coming in contact with the developing roller 322. At this time, the toner 311 is desorbed from the magnetic carrier 312, and adheres to the developing roller 322.

As described above, the developer 310 restrained by the developer collection member 323 is carried in the rotational direction j from the downstream of the rotational direction h. Since the developer 310 already consumed the toner 311 in the upstream of the rotational direction j, the magnetic carrier 312 within the developer 310 has an ability of collecting a toner. Thus, when the developer 310 carried in the rotational direction j of the developer collection member 323 comes in contact with the toner 311 adhering to the developing roller 322, the toner 311 is collected by the magnetic carrier 312, and returned into the developing container 321.

FIGS. 27A and 27B are schematic views illustrating that the toner 311 adhering to the developing roller 322 is collected by the magnetic carrier 312 of the developer 310.

When the developer 310 collides with the toner 311 on the developing roller 322 (FIG. 27A), a couple of forces act on the toner 311, and rotates the toner on the developing roller 322 (FIG. 27B). Thus, the adhering force between the toner and the developing roller decreases. At this time, since the magnetic carrier 312 is electrically charged at the opposite-polarity by the charge of the consumed toner, the toner covering the developing roller is scraped by the magnetic carrier 312 while passing through the developer regulation region G. As such, since a scraping trace is formed in the carrying direction of the developer 310, that is, substantially in parallel to the rotational direction of the developing roller or the developer collection member by the magnetic carrier, a uniform toner layer cannot be formed on the developing roller.

SUMMARY OF THE INVENTION

The present invention provides a developing device and an image forming apparatus, which are capable of obtaining a high-density toner image having high image uniformity in addition to obtaining a desired density even at a smaller toner amount.

According to an embodiment of the present invention, there is provided a developing device that develops an electrostatic image formed in an image bearing member using a developer including a nonmagnetic toner and a magnetic carrier. The developing device includes: a toner bearing member which bears a toner to be supplied to the image bearing member in which an electrostatic image is formed; a developer supply member which supplies the developer to the toner bearing member; a developer collection member which collects the developer supplied to the toner bearing member. The toner bearing member has a plurality of convex portions formed on the surface thereof and extended in a direction crossing a developer carrying direction, wherein the plurality of protrusion portions are configured to allow the toner having average particle diameter to contact with a concave inside portion formed between two tops of the protrusion portions neighboring to each other and not allow the carrier having average particle diameter to contact with the concave inside portion, and height of the tops of the protrusion portions are configured to be smaller than the average particle diameter of the toner, and at a developing portion at which the toner bearing member and the image bearing member face each other to develop the electrostatic image, the toner bearing member and the image bearing member can be moved so as to have a relative velocity difference.

The present invention can provide a developing device and an image forming apparatus capable of the following: as a plurality of convex portions is arranged on the surface of the toner bearing member, the interval between the adjacent convex portions is set to be equal to or more than the toner particle diameter and less than the carrier particle diameter, and the height of the convex portion is set to be equal to or less than the toner particle diameter, the toner bearing body can be uniformly covered with a single layer of toner. Furthermore, although a smaller toner amount is used, a uniform and high-density toner image can be developed on the image bearing member.

Further features of the present invention will become apparent from the following description of exemplary embodiments with reference to the attached drawings.

DESCRIPTION OF THE EMBODIMENTS

Configuration of Image Forming Apparatus

Figure 1:
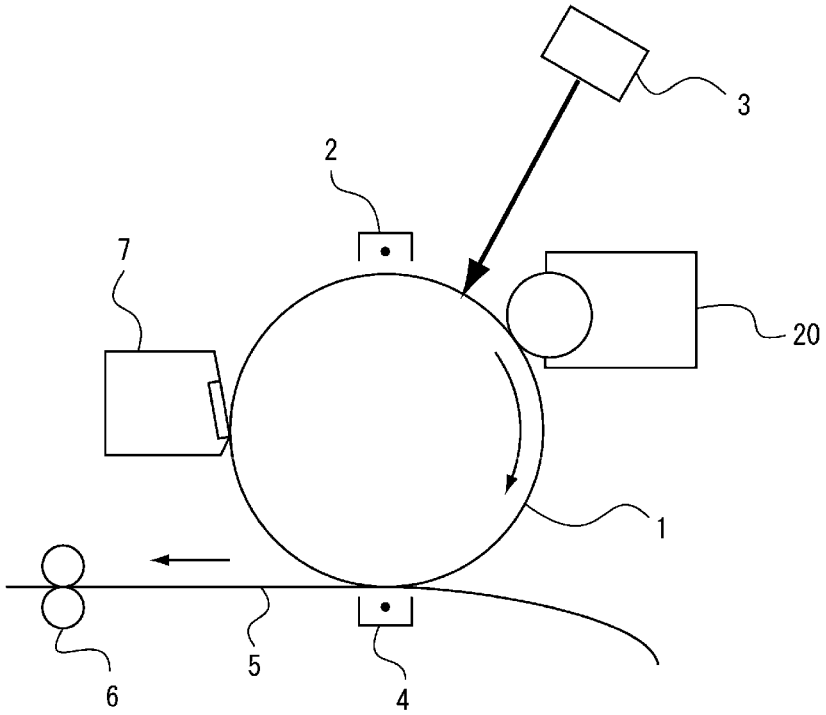
FIG. 1 is a schematic view of an image forming apparatus using a developing device according to an embodiment of the present invention.

FIG. 1 is a schematic view of an image forming apparatus using a developing device according to an embodiment of the present invention.

An example in which the present invention is embodied as an image forming apparatus using an electrophotographic system as illustrated in FIG. 1 will be described. However, the dimensions, materials, shapes, and relative arrangements of components described in the embodiment do not limit the scope of the present invention.

The image forming apparatus using an electrophotographic system in FIG. 1 includes a drum-shaped electrophotographic photoreceptor 1 which is formed by applying a photoconductor layer on a conductive substrate and rotatably provided as an image bearing member for bearing an electrostatic image. The image forming apparatus uniformly charges the photoreceptor 1 through a charger 2. Then, the image forming apparatus forms an electrostatic image by exposing the photoreceptor 1 using a light emitting element 3 such as laser, based on an information signal, and visualizes the electrostatic image through a developing device 20 using a developer including a nonmagnetic toner and a magnetic carrier. Then, the visualized image is transferred onto a transfer sheet 5 by a transfer charger 4, and fixed on the transfer sheet by a fixing device 6. Furthermore, the nonmagnetic toner which is not transferred onto the photoreceptor 1 but remains is removed from the photoreceptor 1 by a cleaning device 7.

First Embodiment

Figure 2:
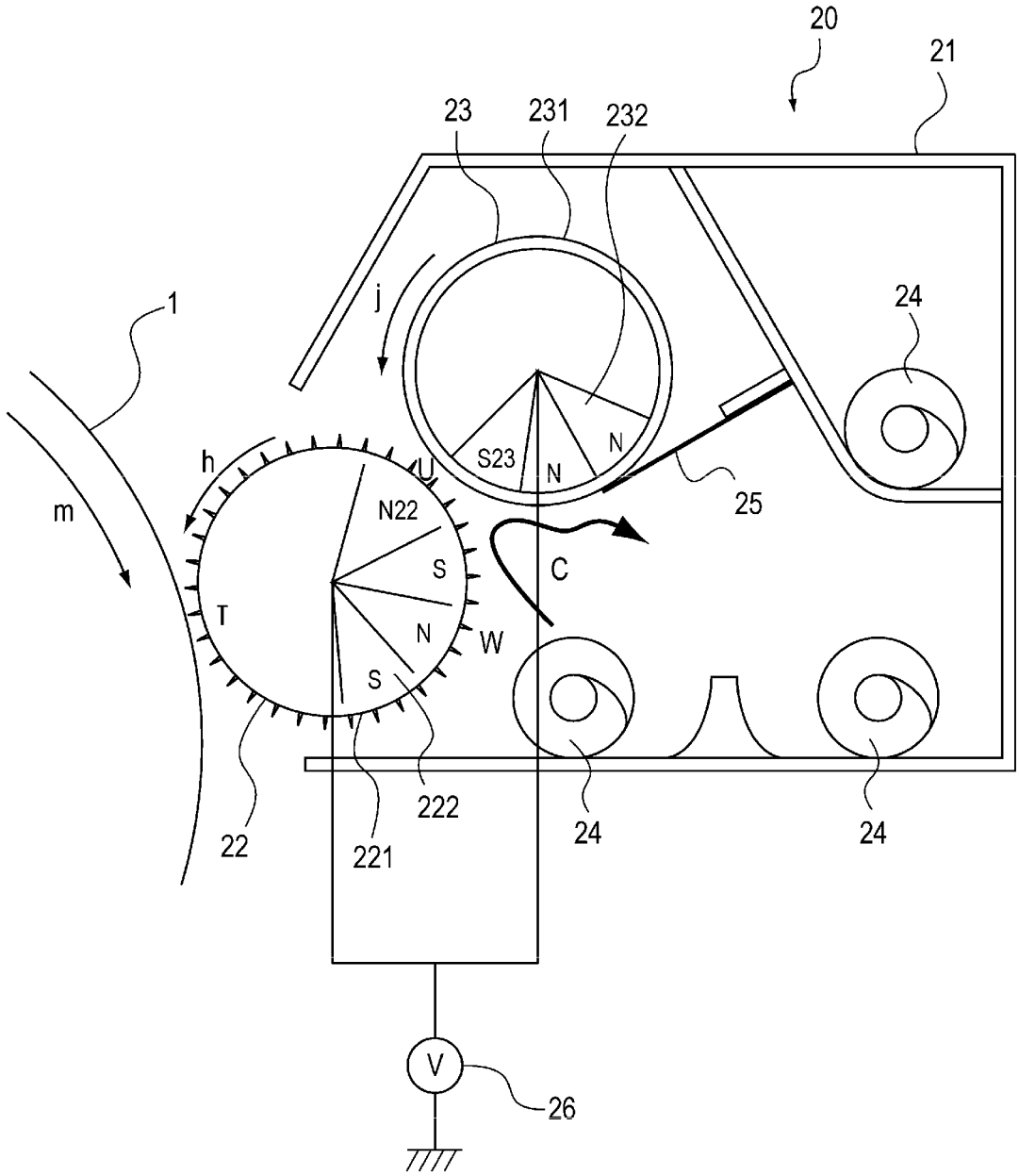
FIG. 2 is a schematic view of a developing device according to an embodiment of the present invention.

FIG. 2 is a schematic view of a developing device according to an embodiment of the present invention.

(Configuration of Developing Device)

Inside a developing container 21, a developer supply member 24 and a developer collection member 23 are arranged to face a toner bearing member 22, with a gap provided therebetween. The developer supply member 24 supplies a developer to the toner bearing member 22, and the developer collection member 23 collects a developer on the toner bearing member 22. The developer supply member 24 stirs the developer collected by the developer collection member 23, carries the developer to a supply portion W at which the toner bearing member 22 and the developer supply member 24 face each other, and supplies the developer using a magnetic force applied by a permanent magnet 222.

The developer collection member 23 includes a rotatable roller 231 and a permanent magnet 332 fixed and arranged therein. The roller 231 is rotatably provided to move in the opposite direction in a collection portion U at which the toner bearing member 22 and the roller 231 face each other. A part of the developer supplied to the toner bearing member by the developer supply member 24 is collected by a magnetic force acting applied through a magnetic field formed in cooperation between a permanent magnet 222 and the permanent magnet 332, before being carried to a developing portion T. Thus, the developer collection member 23 is disposed at a position in the upstream of the developing portion T and the downstream of the supply portion W, with respect to the moving direction of the toner bearing member 22.

(Configuration of Toner Bearing Member)

The developing device 20 according to the present embodiment is arranged to face the photoreceptor 1. The developing container 21 of the developing device 20 has an opening in which the toner bearing member 22 is provided to face the photoreceptor 1. The toner bearing member 22 includes a rotatable roller 221 and a permanent magnet 222 fixed and arranged therein. The roller 221 is formed by covering a base layer 221*b* with an elastic layer 221*a*. The base layer 221*b* is a cylindrical member formed of a metallic material. The base layer 221*b* can be formed of any conductive rigid member such as SUS, steel, or aluminum.

The base material of the elastic layer roller 221*a* may include rubber materials such as silicone rubber, acrylic rubber, nitrile rubber, urethane rubber, ethylene-propylene rubber, isopropylene rubber, or styrene-butadiene rubber, which has proper elasticity. Furthermore, conductive microparticles such as carbon, titanium oxide, and metallic microparticles may be added to the base material such that conductivity is imparted to the base material. Furthermore, in addition to the conductive microparticles, spherical resin may be dispersed to adjust surface roughness.

In the present embodiment, the toner bearing member 22 having the elastic layer roller 221*a* formed on the base layer roller 221*b* is used, the elastic layer roller 221*a* including urethane rubber and silicon rubber in which carbon is dispersed.

In the present embodiment, the toner bearing member 22 is formed of a material having elasticity or flexibility, in order to bring the toner bearing member 22 into contact with the photoreceptor 1 (contact development). In the case of non-contact development, however, the toner bearing member 22 is formed of a material having conductivity and rigidity, for example, SUS, steel, or aluminum.

Furthermore, the roller 221 has a convex structure formed on the surface thereof, the convex structure including a plurality of convex portions 221*c* which is regularly arranged along the rotational direction h of the roller 221. The rotational direction of the roller 221 corresponds to a developer carrying direction in which the developer is carried, and the plurality of convex portions is provided to extend in a direction crossing the developer carrying direction.

(Configuration of Convex Structure)

Figure 3A:
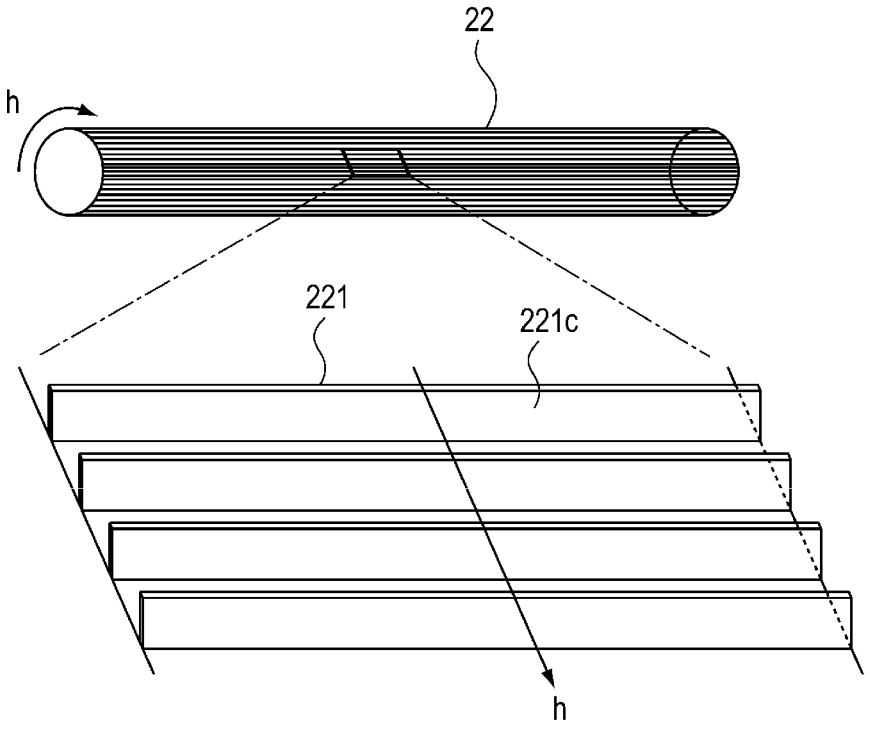
FIGS. 3A and 3B are schematic views illustrating a convex structure of a toner bearing member, FIG. 3A being a schematic view illustrating the convex structure formed on the surface of a roller, and FIG. 3B being a schematic view illustrating a cross-section of the convex structure.
Figure 3B:
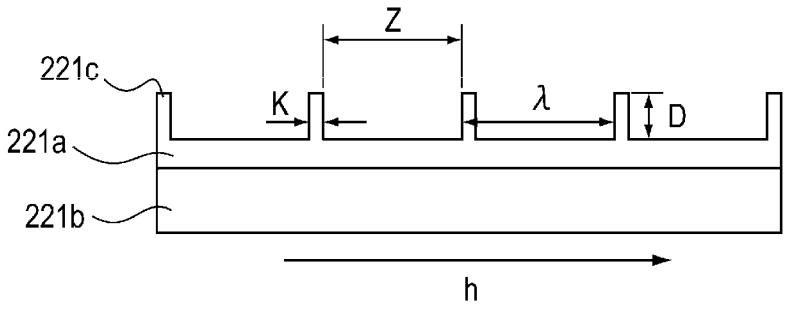

FIGS. 3A and 3B are schematic views illustrating the convex structure of the toner bearing member 22. FIG. 3A is a schematic view illustrating the convex structure formed on the surface of the roller 221, and FIG. 3B is a schematic view illustrating a cross-section of the convex structure.

An arrow h of FIG. 3 indicates the rotational direction of the roller 221. The toner bearing member 22 is arranged to come in contact with the photoreceptor 1, and provided at the developing portion T so as to rotate in the same direction h with respect to the rotational direction m of the photoreceptor 1.

In the present embodiment, the convex structure is directly formed on the elastic layer 221*a*. However, a resin layer may be provided on the elastic layer, and the convex structure may be formed on the resin layer. At this time, a primer layer may be provided between the elastic layer and the resin layer, in order to increase adhesion between the elastic layer and the resin layer.

In the present embodiment, the convex structure includes the plurality of convex portions 221*c* which is regularly arranged in parallel to the rotating shaft of the roller 221. Each of the convex portions 221*c* has a width K of 1 μm and a height D of 3.5 μm, and the period λ of intervals between the convex portions 221*c* is 9 μm.

In the present embodiment, the convex structure is arranged in parallel to the rotating shaft. However, the convex structure may be arranged in a direction crossing the rotating shaft. Furthermore, the convex structure according to the present embodiment is not limited to the above-described structure, but the convex portions of the convex structure may be regularly arranged in the rotational direction of the toner bearing member 22. A method for forming the convex structure will be described below in detail.

(Description for Toner Covering and Development of Electrostatic Image)

Figure 4:
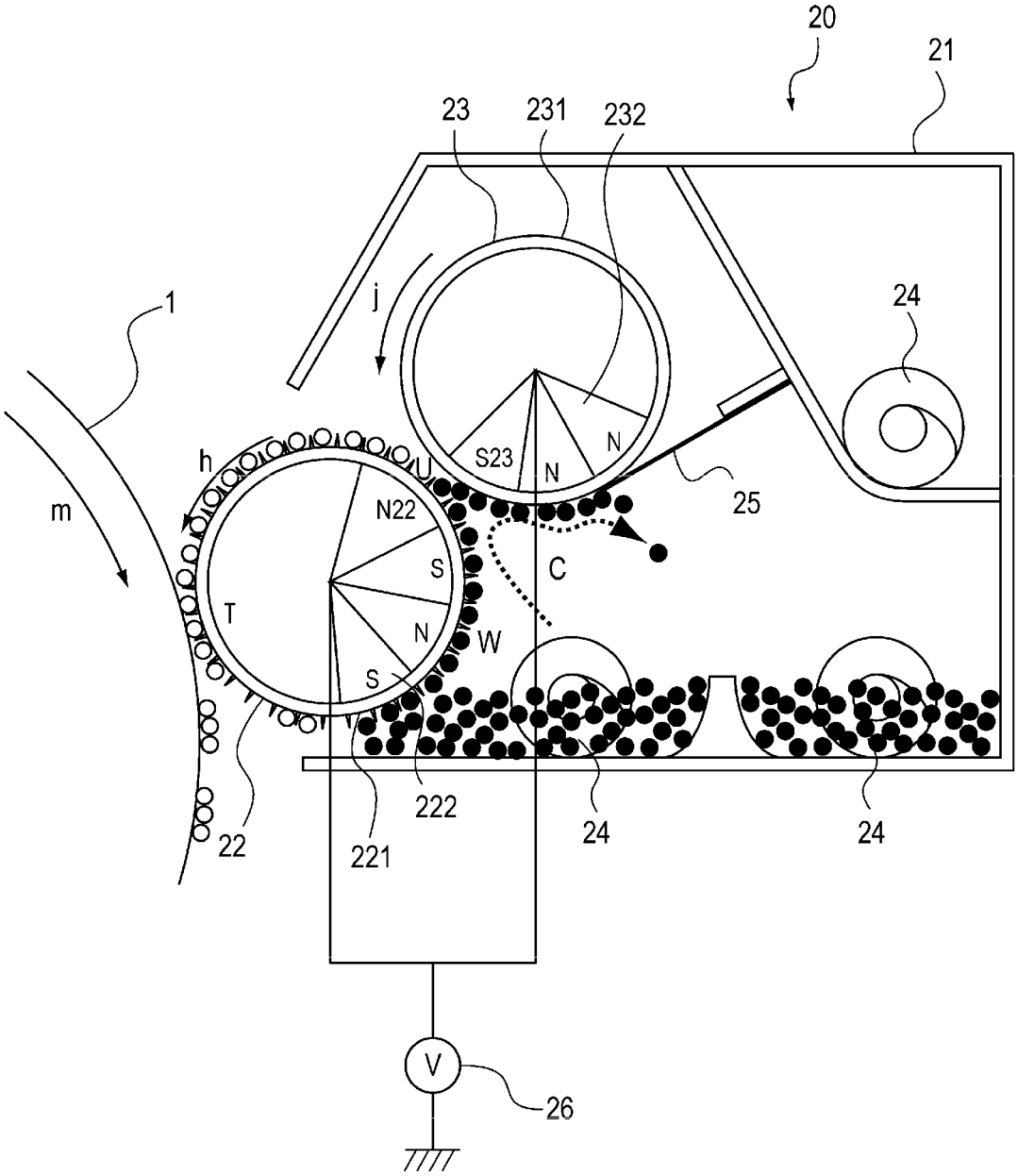
FIG. 4 is a schematic view for describing a toner covering on a toner bearing member and development of an electrostatic image of a photoreceptor.

Next, a toner covering onto the toner bearing member 22 and development of an electrostatic image of the photoreceptor 1 will be described with reference to FIG. 4.

In the present embodiment, a covering refers to a state in which toner particles are in contact with the surface of the photoreceptor 1 or the toner bearing member 22, and is not necessarily limited to a state in which a lot of toner particles cover the entire surface of the toner bearing member 22. In addition, other details will be described below.

At the supply portion W, a two-component developer 10 is supplied to the toner bearing member 22 having the convex structure arranged on the surface thereof through the developer supply member 24. Until the two-component developer 10 is supplied to the toner bearing member 22 and collected by the developer collection member 23, the toner within the two-component developer 10 contacted with the roller 221 of the toner bearing member 22 comes in contact with the side surfaces of the convex portions 221*c* and forms a uniform and thin covering layer on the surface of the roller 221. The two-component developer 10 excluding the toner related to the formation of the covering layer is collected by the developer collection member 23 at the collection portion U through a magnetic force.

On the other hand, the toner which is not collected but covers the toner bearing member 22 comes in contact with the photoreceptor 1 at the developing portion T, and covers the photoreceptor 1 according to a potential difference. At this time, since the covering of the toner bearing member 22 is regularly uniform, a moving velocity ratio $v_{22}/v_1$ may be property set to uniformly develop a high-density toner image on the photoreceptor 1. The moving velocity $v_{22}$ indicates the moving velocity of the roller 221 of the toner bearing member 22, and the moving velocity $v_1$ indicates the moving velocity of the photoreceptor 1.

Furthermore, examples of the superiority to a hybrid development method according to the related art may include the stability in development amount, in addition to the above-described high-density toner image. As expressed above in Equation 1, when the potential difference ΔV is determined in the case of the hybrid development method, the covering amount relies on Q/M. That is, when Q/M of the developer is changed by an environment variation or endurance, the covering amount is significantly changed. Thus, in the hybrid development method, the covering amount or Q/M is sensed, and complex potential control is required.

In the present embodiment, however, since the toner comes in multipoint contact with the convex structure on the toner bearing member 22, the space between the convex portions 221*c* of the convex structure can be covered even by a smaller electrostatic adhesion force than when the toner comes in point contact with the outer circumferential surface of the roller. That is, although the charge quantity of the toner and the electrostatic adhesion force are changed, the amount of toner covering the convex structure is hardly changed, and a stable covering by the toner can be realized without relying on complex potential control.

Hereinafter, toner covering onto the toner bearing member 22 and development of an electrostatic image of the photoreceptor 1 will be described in detail with reference to FIG. 4.

The two-component developer 10 within the developing container 21 is stirred by the developer supply member 24, and carried to a developer supply portion X. In the present embodiment, a positive charge-type toner is used. The positive charge-type toner is produced by a polymerization method, and has a number average particle diameter $r_t$ of 7.7 μm. Furthermore, a standard carrier P-01 (Imaging Society of Japan) of which the number average particle diameter $r_t$ is 90 μm is used as a magnetic carrier. A method for measuring the number average particle diameters of the toner and the magnetic carrier will be described in detail. Furthermore, the toner and the magnetic carrier are not limited to the above-described toner and magnetic carrier, but a publicly known toner and magnetic carrier which are generally used can be used.

First, the toner and the magnetic carrier are mixed at a toner mass ratio (TD ratio) of 7% with respect to the entire mass, in order to prepare the two-component developer 10. The two-component developer 10 carried to the developer supply portion X is supplied to the roller 221 by a magnetic field generated through the plurality of permanent magnets 222 fixed and arranged in the toner bearing member 22. The supplied two-component developer 10 forms magnetic brushes by receiving the influence of the movement of the roller 221 and the magnetic field generated by the permanent magnet 222, and is carried in the movement direction h of the roller 221.

Figure 5A:
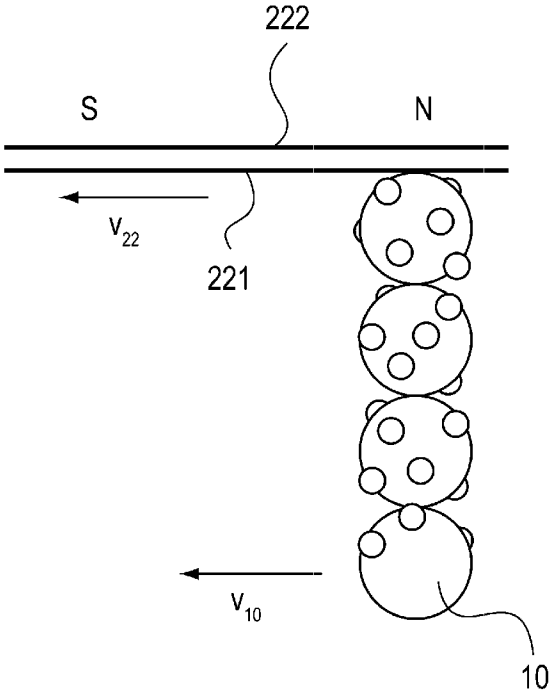
FIGS. 5A to 5C are schematic views illustrating a state in which a two-component developer is carried.
Figure 5B:
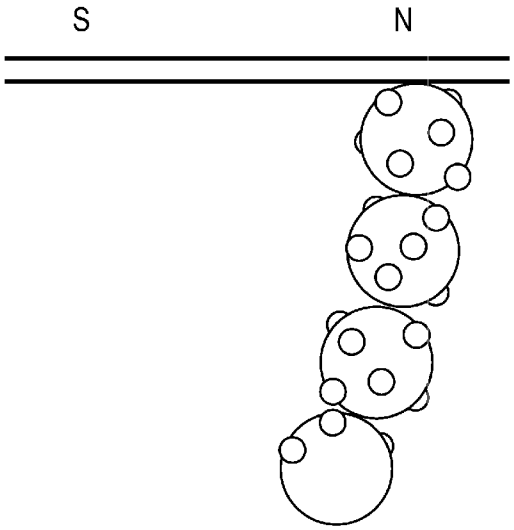
Figure 5C:
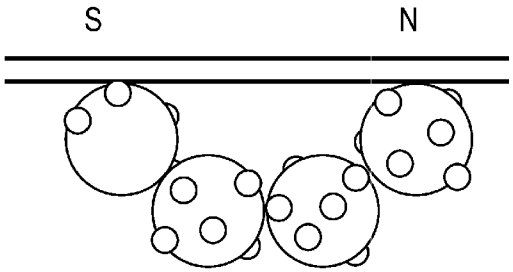

FIGS. 5A to 5C are schematic views illustrating a state in which the two-component developer 10 is carried. Through the magnetic field generated by the permanent magnet 222, the two-component developer 10 forms magnetic brushes (FIG. 5A). Then, as the roller 221 is moved, the magnetic brushes start to be affected by an adjacent pole (FIG. 5B). Moreover, as the roller 221 is further moved, the magnetic brushes are strained by the adjacent pole (FIG. 5C). Then, this process is repeated. Thus, the average moving velocity $v_{10}$ of the two-component developer 10 has a relative velocity difference ($v_{10}>v_{22}$) from the moving velocity $v_{22}$ of the roller 221.

Figure 6:
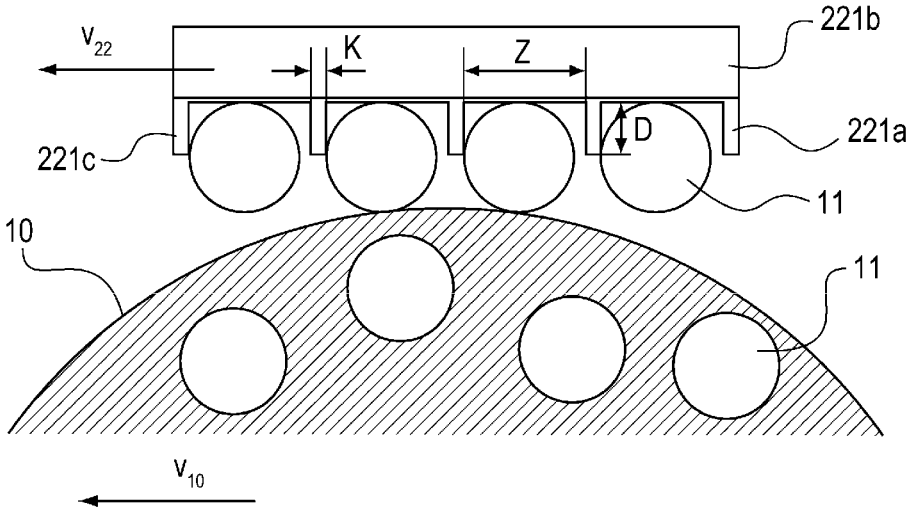
FIG. 6 is a schematic view for describing the behavior of a toner at the roller, when the two-component developer is carried.

FIG. 6 is a schematic view for describing the behavior of the toner at the roller 221, when the two-component developer 10 is carried. FIG. 6 illustrates only one magnetic carrier. In reality, however, a plurality of magnetic carriers with magnetic brushes formed exists.

As illustrated in FIG. 6, the roller 221 has the convex structure formed thereon, the convex structure including the plurality of convex portion 221*c* arranged substantially perpendicular to the moving direction. Furthermore, an opening width Z (=λ−K) set by the adjacent convex portions 221*c* is set to be equal to or more than a toner particle diameter $r_t$ and less than a carrier particle diameter $r_c$, and the height D of the convex portion 221*c* is set to be equal to or less than the toner particle diameter $r_t$.

As the opening width Z is set to be equal or more than the toner particle diameter $r_t$ and less than the carrier particle diameter $r_c$, the magnetic carrier cannot enter the opening formed by the adjacent convex portions 221*c*. Thus, the toner 11 which comes in multipoint contact with the side surfaces of the convex portion 221*c* and the surface between the convex portions 221*c* (bottom surface of the convex structure) is hardly scraped by magnetic brushes which are carried later. Furthermore, as the height D of the convex structure is set to be equal to or less than the toner particle diameter $r_t$, a single layer of toner can be formed on the convex structure, because the convex portion 221*c* has no side surface to which a second layer of toner adheres.

When the above-described convex structure according to the present embodiment is applied, the roller 221 of the toner bearing member 22 can be stably and uniformly covered with substantially a single layer of toner.

Figure 7A:
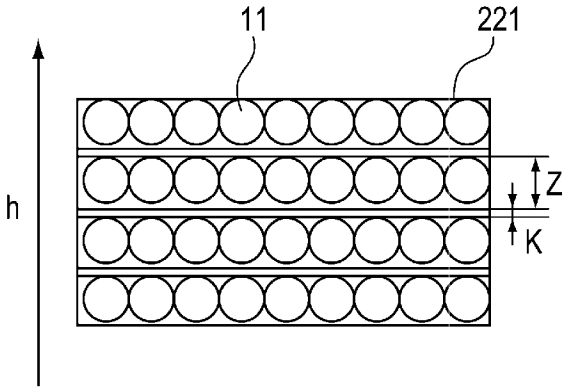
FIGS. 7A to 7C are schematic views illustrating a toner covering the roller.
Figure 7B:
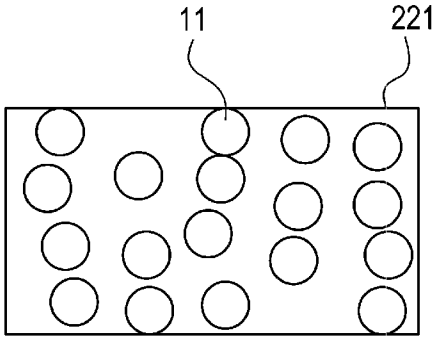
Figure 7C:
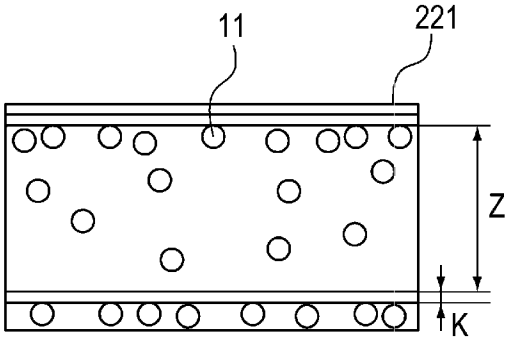

FIGS. 7A to 7C are schematic views illustrating the toner 11 covering the roller 221. FIG. 7A is a schematic view illustrating the toner 11 which covers the roller 221 having the convex structure according to the present embodiment. As comparative examples, FIG. 7B is a schematic view illustrating a toner 11 on a roller 221 having no convex structure, and FIG. 7C is a schematic view illustrating a toner 11 on the roller 221 of which the opening width Z is larger than the carrier particle diameter $r_c$. An arrow of FIG. 7 A to 7C indicates the moving direction of the roller 221.

When the roller 221 has no convex structure as illustrated in FIG. 7B, a scraping trace of magnetic brushes prominently appears in substantially parallel to the carrying direction of the magnetic brushes, that is, the moving direction of the roller 221. Thus, a uniform covering cannot be formed by the toner 11. As illustrated in FIG. 7C, when the opening width Z is equal to or more than the carrier particle diameter $r_c$, the magnetic carrier can enter the opening. Thus, a uniform covering cannot be formed by the toner.

The opening width Z may be set to be three times smaller than the toner particle diameter ($Z<3r_t$). Then, the space which the toner enters is limited, except the space where the toner comes in multipoint contact with the side surface of the convex portion 221*c* and the bottom surface between the convex portions 221*c*. Thus, a single layer of toner can be further stably and uniformly formed.

The height D of the convex portion 221*c* may be set to 50% of the toner particle diameter rt, in order to secure a contact between the toner and the side surface of the convex portion 221*c* and a contact between the photoreceptor 1 and the toner related to covering at the side surface of the convex portion 221*c*. At this time, considering the particle size distribution of the toner, the height D of the convex portion 221*c* may be set to be equal to or more than $r_{t10}/2$ and equal to or less than $r_{t90}/2$. Here, $r_{t10}$ represents the diameter of particles of which the cumulative number distribution is 10% in the toner particle size distribution, and $r_{t90}$ represents the diameter of particles of which the cumulative number distribution is 90%. As the height D of the convex portion 221*c* becomes smaller than $r_{t10}/2$, the contact between the toner and the side surface of the convex portion 221*c* is reduced, and the particle diameter of the toner covering the roller 221 is limited. Then, a uniform toner covering cannot be formed.

On the other hand, as the height D of the convex portion 221*c* becomes larger than $r_{t90}/2$, the contact between the photoreceptor 1 and the toner in contact with the side surface of the convex portion 221*c* is reduced, and the particle diameter at which an electrostatic image of the photoreceptor 1 can be developed is limited. Then, high-density development cannot be performed.

The convex structure used in the present embodiment has a height D of 3.5 μm and an opening width Z of 8 μm, while the toner particle diameter $r_t$ is 7.7 μm. The two-component developer 10 can be moved on the roller 221 so as to have a relative velocity difference ($v_{10}>v_{22}$). At this time, the toner within the carried two-component developer 10 is charged by coming in frictional contact with the convex structure of the roller 221. Then, as the toner comes in multipoint contact with the convex structure through the electrostatic adhesion force, a single covering layer of toner is formed. Thus, compared to when a toner comes in point contact with only the outer circumferential surface of the roller, a covering layer of toner can be formed by a small electrostatic adhesion force.

On the other hand, when the electrostatic adhesion force becomes larger at the contact point, the contact frequency or friction of the developer and the roller 221 with respect to the toner carrying member does not need to be excessively increased, which makes it possible to suppress deterioration of the developer. Thus, a charging series of the toner, the magnetic carrier, and the surface material (elastic layer 221*a*) of the roller 221 may be set to a condition in which the magnetic carrier is positioned between the toner and the surface material of the roller 221. Under such a condition, a charging series difference between the toner and the surface material of the roller 221 becomes larger than a charging series difference between the toner and the magnetic carrier.

Thus, when the toner is charged by coming in frictional contact with the roller 221, a strong electrostatic adhesion force is generated in comparison to the electrostatic adhesion force between the toner and the magnetic carrier. Then, the toner is separated from the magnetic carrier, and easily adheres to the roller 221.

When the above-described developing device according to the present embodiment is applied, a uniform covering layer of toner can be formed without excessively increasing the contact frequency or friction between the developer and the toner carrying portion. A method for determining the charging series will be described below.

(Configuration of Developer Collection)

The two-component developer 10 on the roller 221 of the toner bearing member 22 is carried to the collection portion U at which the toner bearing member 22 and the developer collection member 23 face each other. The collection portion U generates a strong magnetic field through the N poles $N_{22}$ of the permanent magnets 222 which are a plurality of magnetic members fixed and arranged in the toner bearing member 22 and the S poles $S_{23}$ of the permanent magnets 332 which are a plurality of magnetic members fixed and arranged in the developer collection member. Thus, the two-component developer 10 carried to the collection portion U is collected by the developer collection member 23, except for the toner covering the roller 221.

The collected two-component developer 10 is carried to move in the rotational direction j of the roller 231, scraped from the roller 231 by the influence of the magnetic field of the permanent magnet 332 and a scraper 25, stirred again by the developer supply member 24, and carried to the supply portion W.

On the other hand, the toner which is not collected by the developer collection member 23 but is in contact with the side surface of the convex portion 221*c* of the roller 221 is carried to the developing portion T. At the developing portion T, the toner bearing member 22 and the photoreceptor 1 come in contact with each other, and a potential difference occurs due to an electrostatic image potential on the photoreceptor and a voltage applied by a voltage application portion 26.

In the present embodiment, the toner bearing member 22 and the photoreceptor 1 are brought in contact with each other such that the entry amount of the toner bearing member 22 into the photoreceptor 1 becomes 50 μm. Furthermore, DC 400V is applied to the toner bearing member 22, while the electrostatic image potential $V_L$ of the photoreceptor 1 is 100V. Furthermore, the developer collection member 23 receives a voltage from the voltage application portion 26, and is wired at the same potential as the toner bearing member 22. However, the developer collection member 23 may be electrically floated.

(Moving Velocity Ratio of Roller to Photoreceptor and Image Evaluation)

The roller 221 and the photoreceptor 1 are rotated in the same direction (h direction and m direction) at the developing portion T, and the velocities thereof have a relative velocity difference. In the present embodiment, the moving velocity $v_1$ of the photoreceptor 1 is set to 200 mm/s, and the moving velocity $v_{22}$ of the roller 221 is set to 260 mm/s.

Figure 8:
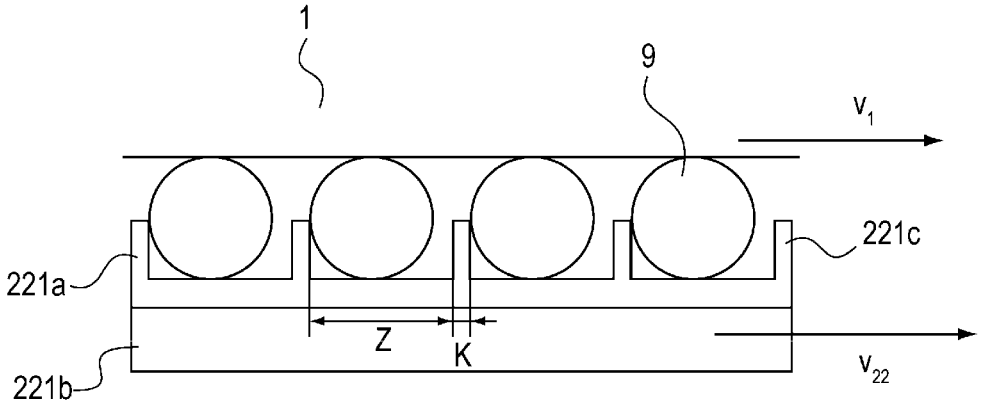
FIG. 8 is a schematic view of a developing portion at which the roller and the photoreceptor face each other.

FIG. 8 is a schematic view of the developing portion T at which the roller 221 and the photoreceptor 1 face each other.

In the present embodiment, since the opening width Z of 8 μm is equal to or more than the average toner particle diameter $r_t$ of 7.7 μm and twice smaller than the toner particle diameter, only one toner having the average toner particle diameter enters between the adjacent convex portions 221*c*.

Figure 9A:
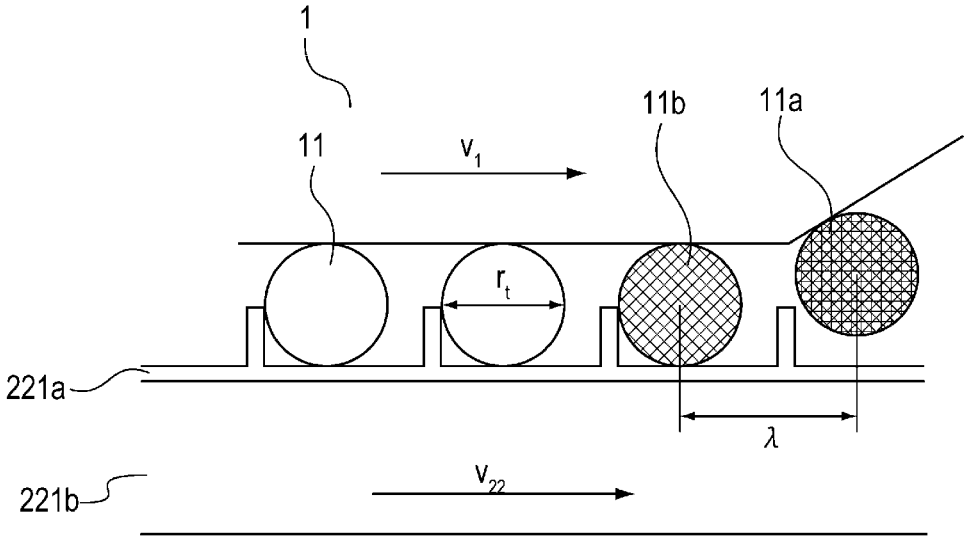
FIGS. 9A and 9B are schematic views of the rear end of a developing portion.
Figure 9B:
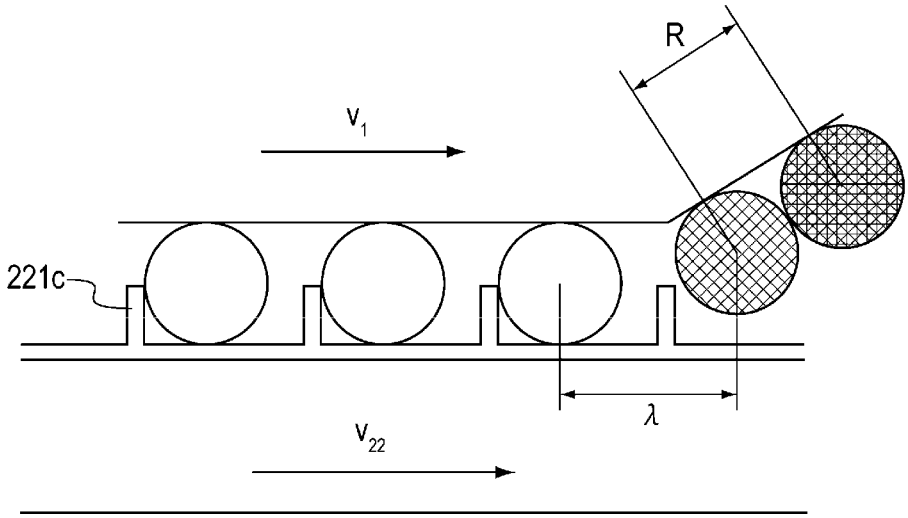

FIGS. 9A and 9B are schematic views of the rear end of the developing portion T. FIG. 9A is a schematic view illustrating that a leading toner 11*a* in the moving direction passes through the rear end of the developing portion, and FIG. 9B is a schematic view illustrating that a neighboring toner 11*b* passes through the rear end of the developing portion after t seconds.

The toner receives a force in a direction from the roller 221 toward the photoreceptor 1 due to the potential difference applied, and a couple of forces act on the toner due to the relative velocity difference in rotation velocity between the roller 221 and the photoreceptor 1 at the developing portion. Thus, the toner is easily rotated. Thus, as the adhesion force between the toner and the roller 221 decreases, the toner is moved toward the photoreceptor 1 so as to develop an electrostatic image on the surface of the photoreceptor 1.

At this time, the condition in which the high-density electrostatic image is developed on the photoreceptor 1 by the toner is classified according to the condition of the opening width Z and the toner particle diameter $r_t$.

(A) in case of $r_t \leq Z < 2r_t$

In this case, when the toners 11*a* and 11*b* covering the photoreceptor 1 after t seconds come in contact with each other, a distance R between the centers of the toners 11*a* and 11*b* becomes equal to the toner particle diameter $r_t$ (the diameter of the toner).

A time t required for the toner 11*a* to move the distance R may be calculated as follows:

$$t = R/v_1 = r_t/v_1 \quad \text{Equation 2.}$$

Since the toner 11*b* needs to move the distance λ within the time t, the following equation can be established:

$$v_{22} * t = \lambda \quad \text{Equation 3.}$$

According to Equations 2 and 3, the moving velocity ratio $v_{22}/v_1$ of the roller 221 to the photoreceptor 1 can be calculated as follows:

$$v_{22}/v_1 = \lambda/R = \lambda/r_t \quad \text{Equation 4.}$$

In reality, as the toner 11*b* is pressed against the toner 11*a*, the distance R between the centers of the toners becomes equal to or less than the diameter $r_t$ of the toner particle. Thus, Equation 4 can be expressed as follows.

$$v_{22}/v_1 \geq \lambda/R = \lambda/r_t \quad \text{Equation 5}$$

Table 1 shows results of a development amount, coverage, and density evaluation after fixing, when the moving velocity ratio $v_{22}/v_1$ is changed, in the present embodiment. The respective evaluation methods will be described below.

TABLE 1

| $v_{22}/v_1$ | 1.1 | 1.2 | 1.3 | 1.4 | 1.5 | 1.6 |
|---|---|---|---|---|---|---|
| Development amount ($mg/cm^2$) | 0.35 | 0.38 | 0.41 | 0.44 | 0.47 | 0.50 |
| Coverage (%) | 74 | 80 | 86 | 92 | 93 | 96 |
| Density evaluation | X | ○ | ○ | ○ | ○ | ○ |

Z=8.0 μm, K=1.0 μm, λ=9.0 μm, and $r_t$=7.7 μm.

According to Equation 5, the condition in which the toners come in contact with the developing roller so as to form a high-density covering layer may be set as follows.

$$v_{22}/v_1 \geq 1.17$$

As obvious from Table 1, it is confirmed that when the moving velocity ratio is set to the moving velocity ratio $v_{22}/v_1$ of 1.2 or more, which satisfies Equation 5, high-density development using the toner can be performed on the photoreceptor 1, which makes it possible to accomplish a desired density. Moreover, when a multiple layer of toner is used for covering, the moving velocity ratio may be set to be equal to or more than a moving velocity ratio obtained by multiplying the moving velocity ratio of Equation 5 by a desired number of toner layers.

Next, evaluation results under a condition of $v_{22}/v_1$=1.4 based on the present embodiment are compared to evaluation results obtained by the hybrid method as a comparative example. Table 2 shows results of a development amount, coverage, density evaluation after fixing, and image uniformity evaluation, when an electrostatic image is developed on the photoreceptor 1 by the toner.

TABLE 2

| | Development amount ($mg/cm^2$) | Coverage (%) | Density evaluation | Image uniformity evaluation |
|---|---|---|---|---|
| Method of present embodiment | 0.44 | 92 | ○ | ○ |
| Hybrid method | 0.44 | 76 | X | X |

In the method according to the present embodiment, it is confirmed that a single layer and a high-density toner image can be formed. In the hybrid method, however, the coverage is low, and a plurality of second toner layers exists, even though the development amount is adjusted to the same as the development in the method according to the present embodiment.

Thus, in the method according to the present embodiment, it is confirmed that a desired image density can be achieved. In the hybrid method, however, since the image density is significantly reduced by the influence of white background portions where no toner exists, a desired density cannot be achieved.

In the method according to the present embodiment, it is confirmed that since a toner image obtained through development has small unevenness in the height direction thereof, the image uniformity reaches a permissible level. In the hybrid method, however, a toner image obtained through development has large unevenness in the height direction thereof, and the image uniformity does not reach the permissible level.

Furthermore, it is confirmed that due to an adverse effect caused by the low coverage of the toner bearing member 22, images formed on the photoreceptor 1 and the sheet have a low toner density, and the image density is significantly reduced by the influence of white background portions where no toner exists. Thus, the desired density cannot be achieved.

(B) in case of $2r_t \leq Z < r_c$

Derivation of the moving velocity ratio $v_{22}/v_1$ under the condition of $2r_t \leq Z < r_c$ will be described.

Figure 10:
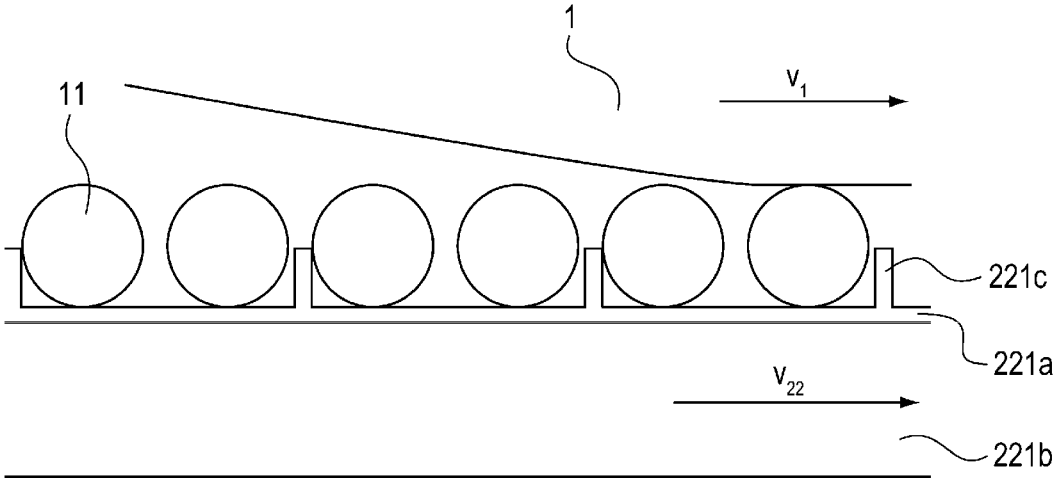
FIG. 10 is a schematic view of the roller before entering the developing portion, when $2r_t \leq Z < r_c$ is satisfied.

FIG. 10 is a schematic view of the roller before entering the developing portion T. Before entering the developing portion, two toners exist on the roller 221. More specifically, the two toners exist at positions where the two toners can come in contact with both the side surface of the convex portion 221*c* of the convex structure and the surface of the roller 221 between the convex portions 221*c* (the bottom surface between the convex portions).

Figure 11A:
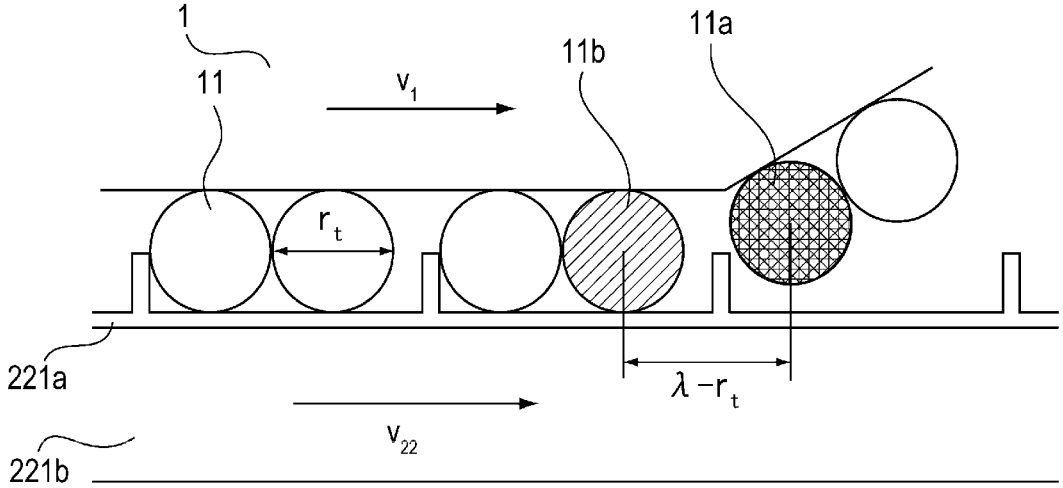
FIGS. 11A and 11B are schematic views of the rear end of the developing portion, when $2r_t \leq Z < r_c$ is satisfied.
Figure 11B:
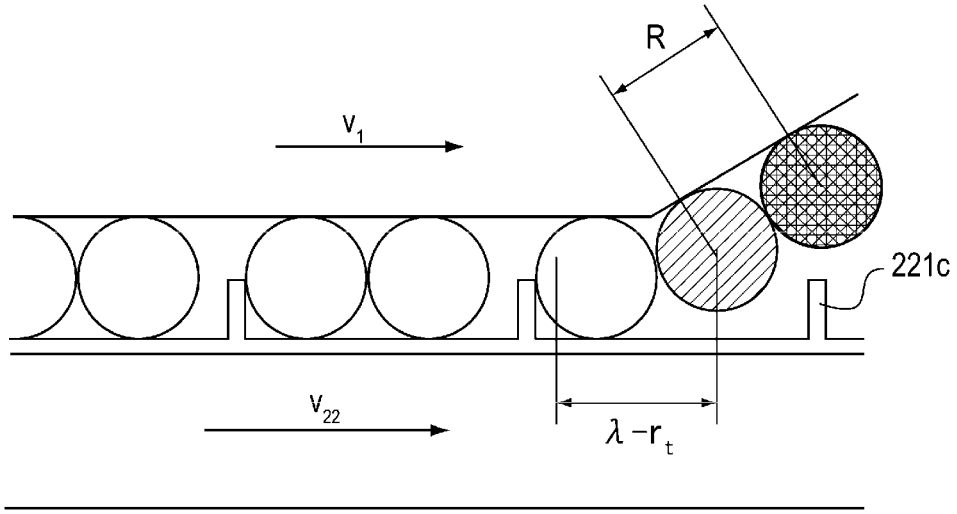

FIGS. 11A and 11B are schematic views of the rear end of the developing portion. A toner is rotated and moved to the downstream in the moving direction ($v_{22}$) of the roller 221, according to the moving velocity ratio $v_{22}/v_2$ during contact.

FIG. 11A is a schematic view when a toner 11*a* passes through the rear end of a contact portion, and FIG. 11B is a schematic view when a neighboring toner 11*b* passes through the rear end of the contact portion after t seconds. The condition in which a high-density toner image can be developed on the photoreceptor 1 is that the toner 11*a* moves a distance R and the toner 11*b* moves a distance $(\lambda-r_t)$ for t seconds. From this relation, Equation 6 below is obtained.

$$v_{22}/v_1 \geq (\lambda-r_t)/R=(\lambda-r_t)/r_t \quad \text{Equation 6}$$

Tables 3 to 5 show results obtained by performing the same examination using rollers 221 having different surface structures.

TABLE 3

| $v_{22}/v_1$ | 1.1 | 1.2 | 1.3 | 1.4 | 1.5 | 1.6 |
|---|---|---|---|---|---|---|
| Development amount ($mg/cm^2$) | 0.28 | 0.31 | 0.33 | 0.36 | 0.38 | 0.41 |
| Coverage (%) | 59 | 65 | 69 | 76 | 80 | 85 |
| Density evaluation | X | X | X | X | ○ | ○ |

Z=9.0 μm, K=2.0 μm, λ=11 μm, and $r_t$=7.7 μm

Based on the above-described condition A, a relation of $v_{22}/v_1 \geq 1.43$ is established through Equation 5. In reality, however, a desired density evaluation is obtained when the moving velocity ratio $v_{22}/v_1$ is equal to or more than 1.5, as obvious from Table 3.

TABLE 4

| $v_{22}/v_1$ | 1.1 | 1.2 | 1.3 | 1.4 | 1.5 | 1.6 |
|---|---|---|---|---|---|---|
| Development amount ($mg/cm^2$) | 0.32 | 0.35 | 0.38 | 0.41 | 0.45 | 0.47 |
| Coverage (%) | 67 | 74 | 80 | 86 | 92 | 94 |
| Density evaluation | X | X | ○ | ○ | ○ | ○ |

Z=15 μm, K=2.0 μm, λ=17 μm, and $r_t$=7.7 μm

Based on the above-described condition B, a relation of $v_{22}/v_1 \geq 1.21$ is established through Equation 6. In reality, however, a desired density evaluation is obtained when the moving velocity ratio $v_{22}/v_1$ is equal to or more than 1.3, as obvious from Table 4.

TABLE 5

| $v_{22}/v_1$ | 1.1 | 1.2 | 1.3 | 1.4 | 1.5 | 1.6 |
|---|---|---|---|---|---|---|
| Development amount ($mg/cm^2$) | 0.27 | 0.30 | 0.33 | 0.36 | 0.38 | 0.41 |
| Coverage (%) | 57 | 63 | 69 | 76 | 80 | 86 |
| Density evaluation | X | X | X | X | ○ | ○ |

Z=18 μm, K=1.0 μm, λ=19 μm, and $r_t$=7.7 μm

Based on the above-described condition B, a relation of $v_{22}/v_1 \geq 1.47$ is established through Equation 6. In reality, however, a desired density evaluation is obtained when the moving velocity ratio $v_{22}/v_1$ is equal to or more than 1.5, as obvious from Table 5.

It is confirmed that when the moving velocity ratio is set to the moving velocity ratio $v_{22}/v_1$ satisfying Equations 5 and 6 even though different structures are applied, a high-density toner image can be developed on the photoreceptor 1, and a desired density can be achieved.

When the opening width Z becomes equal to or more than the total diameter of three toner particles ($Z \geq 3r_t$), the stability of the development amount is degraded.

Figure 12:
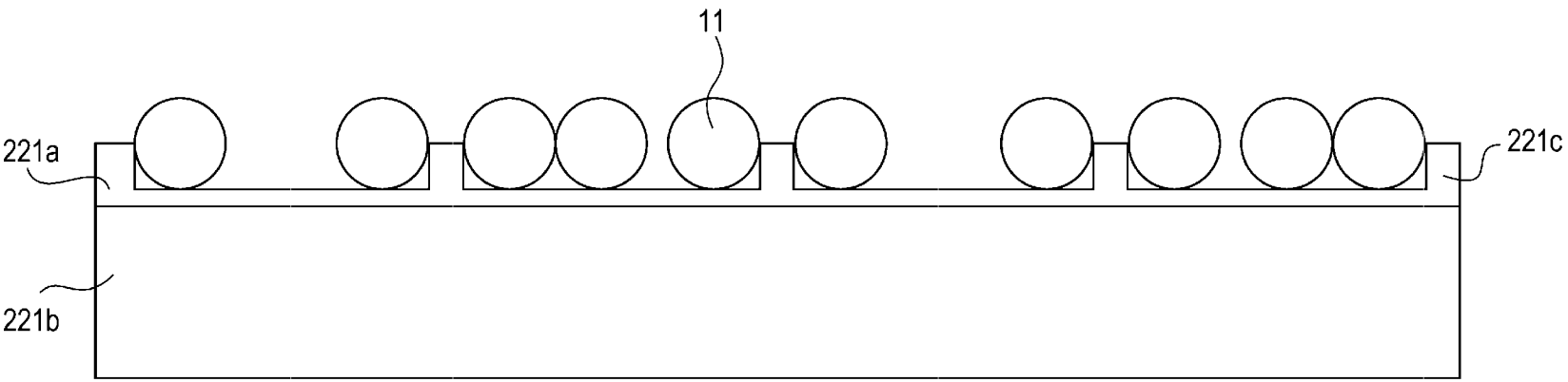
FIG. 12 is a schematic view of the roller of which an opening width is equal to or more than the total diameter of three toner particles.

FIG. 12 is a schematic view of the roller 221 of which the opening width Z is equal to or more than the total diameter of three toner particles.

As illustrated in FIG. 12, when the opening width Z is equal to or more than the total diameter of three toner particles ($Z \geq 3r_t$), one toner having the average particle diameter $r_t$ is likely to come in contact with only the bottom surface between the convex portions 221*c*, while two toners come in contact with both the side surfaces of the convex portion 221*c* and the bottom surface between the convex portions 221*c*. In this case, the stability of the development amount may be degraded.

Thus, the opening width Z may be set to be smaller than the total diameter of three toner particles ($Z \leq 3r_t$). Under such a condition, a space which an unstable toner coming in contact with only the bottom surface enters is limited between the convex portions 221*c*, a toner amount related to covering is spatially controlled, and a uniform single-layer covering can be stably formed. As a result, the stability of the development amount can be improved.

Tables 6 and 7 show results obtained by performing the same examination using toners having an average particle diameter $r_t$ of 5.0 μm (specific gravity: 1.1 $g/cm^3$).

TABLE 6

| $v_{22}/v_1$ | 1.1 | 1.2 | 1.3 | 1.4 | 1.5 | 1.6 |
|---|---|---|---|---|---|---|
| Development amount ($mg/cm^2$) | 0.19 | 0.21 | 0.23 | 0.25 | 0.27 | 0.29 |
| Coverage (%) | 62 | 67 | 74 | 80 | 86 | 92 |
| Density evaluation | X | X | X | ○ | ○ | ○ |

Z=6.0 μm, K=1.0 μm, λ=7.0 μm, and $r_t$=5.0 μm

Based on the above-described condition A, a relation of $v_{22}/v_1 \geq 1.40$ is established through Equation 5. In reality, however, a desired density evaluation is obtained when the moving velocity ratio $v_{22}/v_1$ is equal to or more than 1.4, as obvious from Table 6.

TABLE 7

| $v_{22}/v_1$ | 1.1 | 1.2 | 1.3 | 1.4 | 1.5 | 1.6 |
|---|---|---|---|---|---|---|
| Development amount ($mg/cm^2$) | 0.19 | 0.21 | 0.23 | 0.25 | 0.27 | 0.29 |
| Coverage (%) | 62 | 67 | 74 | 80 | 86 | 92 |
| Density evaluation | X | X | X | ○ | ○ | ○ |

Z=11 μm, K=1.0 μm, λ=12 μm, and $r_t$=5.0 μm

Based on the above-described condition B, a relation of $v_{22}/v_1 \geq 1.40$ is established through Equation 6. In reality, however, a desired density evaluation is obtained when the moving velocity $v_{22}/v_1$ is equal to or more than 1.4, as obvious from Table 7.

Next, evaluation results under a condition of $v_{22}/v_1$=1.6 based on the present embodiment are compared to evaluation results obtained by the hybrid method as a comparative example. Table 8 shows results of a development amount, coverage, density evaluation after fixing, and image uniformity evaluation, when a toner image is developed on the photoreceptor 1.

TABLE 8

| | Development amount ($mg/cm^2$) | Coverage (%) | Density evaluation | Image uniformity evaluation |
|---|---|---|---|---|
| Method of present embodiment | 0.29 | 92 | ○ | ○ |
| Hybrid method | 0.29 | 77 | X | X |

In the method according to the present embodiment, a single layer and a high-density toner image can be developed. In the hybrid method, however, the coverage is low, and density evaluation is poor, even though the development amount is adjusted to the same development amount as the method according to the present embodiment.

Tables 9 and 10 show results obtained by performing the same examination using toners having an average particle diameter $r_t$ of 10 μm (specific gravity: 1.1 g/cm$^3$).

TABLE 9

| $v_{22}/v_1$ | 1.1 | 1.2 | 1.3 | 1.4 | 1.5 | 1.6 |
|---|---|---|---|---|---|---|
| Development amount (mg/cm$^2$) | 0.46 | 0.49 | 0.53 | 0.57 | 0.60 | 0.62 |
| Coverage (%) | 75 | 80 | 87 | 92 | 93 | 95 |
| Density evaluation | X | ○ | ○ | ○ | ○ | ○ |

Z=11 μm, K=1.0 μm, λ=12 μm, and $r_t$=10 μm

Based on the above-described condition A, a relation of $v_{22}/v_1 \geq 1.20$ is established through Equation 5. In reality, however, a desired density evaluation is obtained when the moving velocity ratio $v_{22}/v_1$ is equal to or more than 1.2, as obvious from Table 9.

TABLE 10

| $v_{22}/v_1$ | 1.1 | 1.2 | 1.3 | 1.4 | 1.5 | 1.6 |
|---|---|---|---|---|---|---|
| Development amount (mg/cm$^2$) | 0.46 | 0.49 | 0.53 | 0.57 | 0.60 | 0.62 |
| Coverage (%) | 75 | 80 | 87 | 92 | 93 | 95 |
| Density evaluation | X | ○ | ○ | ○ | ○ | ○ |

Z=21 μm, K=1.0 μm, λ=22 μm, and $r_t$=10 μm

Based on the above-described condition B, a relation of $v_{22}/v_1 \geq 1.20$ is established through Equation 6. In reality, however, a desired density evaluation is obtained when the moving velocity ratio $v_{22}/v_1$ is equal to or more than 1.2, as obvious from Table 10.

Next, evaluation result under a condition of $v_{22}/v_1$=1.4 based on the present embodiment are compared to evaluation results obtained by the hybrid method as a comparative example. Table 11 shows results of a development amount, coverage, density evaluation after fixing, and image uniformity evaluation, when a toner image is developed on the photoreceptor 1.

TABLE 11

| | Development amount (mg/cm$^2$) | Coverage (%) | Density evaluation | Image uniformity evaluation |
|---|---|---|---|---|
| Method of present embodiment | 0.57 | 92 | ○ | ○ |
| Hybrid method | 0.57 | 75 | X | X |

It is confirmed that when the moving velocity ratio is set to the moving velocity ratio $v_{22}/v_1$ satisfying Equations 5 and 6 even though toners have different particle diameters, a high-density toner image can be developed on the photoreceptor 1. Then, a desired density can be achieved even at a smaller toner amount, and the toner image obtained through the development has small unevenness in the height direction thereof. Thus, the image uniformity can be improved.

As described above, a thin and uniform toner covering is stably formed by bring the two-component developer 10 in contact with the roller 221 having the convex structure on a surface of which the convex portions are regularly arranged and bring the two-component developer 10 in contact with the side surface of the convex portion 221*c* of the convex structure, and a surplus two-component developer 10 is collected by the developer collection member 23. Then, when the toner bearing member 22 and the photoreceptor 1 are arranged to come in contact with each other and a moving velocity ratio is set to the moving velocity ratio determined by Equation 5 or 6, a high-density toner image can be stably developed on the photoreceptor 1 even though a small toner amount is used. Furthermore, a desired density can be obtained, and density unevenness can be improved.

(Relation Between Color Difference and Period of Convex Structure)

In the above-described examination, the convex structure on the toner bearing member 22 is set to a periodic structure in which λ is fixed. However, structures having different periods may be mixed.

Figure 13:
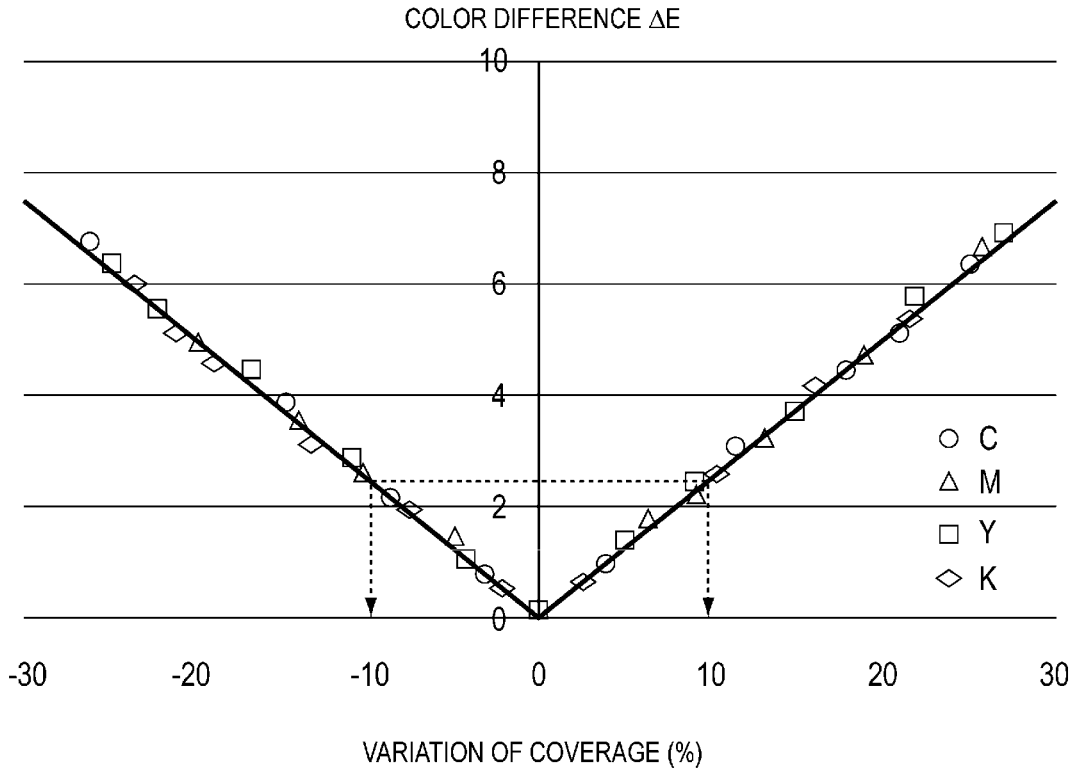
FIG. 13 is a graph illustrating the relation between a variation of development amount and a color difference ΔE, based when the photoreceptor is quantitatively covered with each of color toners.

FIG. 13 is a graph illustrating the relation between a variation (horizontal axis) of development amount and a color difference ΔE (vertical axis), based on when cyan (C), magenta (M), yellow (Y), and black (K) toners are developed on the photoreceptor 1 at a toner amount of 0.45 mg/cm$^2$.

In order to control the in-plane color difference ΔE to 5 or less for the respective colors, the variation of the development amount needs to be set to 20% or less. In the method according to the present embodiment, when the moving velocity ratio $v_{22}/v_1$ is determined, the development amount on the photoreceptor 1 is proportional to λ (Equation 5) or $\lambda - r_t$ (Equation 6) according to the condition A or B of the opening width Z and the toner particle diameter $r_t$. Thus, when the period in case of a variation of 0% is represented by $\lambda_0$ in order to control the in-plane color difference ΔE to 5 or less, the period λ may be set in the following range.

(a) In case of the condition A, the period λ ranges from $0.8\lambda_0$ to $1.2\lambda_0$.

(b) In case of the condition B, the period λ ranges from $(0.8\lambda_0+0.2r_t)$ to $(1.2\lambda_0-0.2r_t)$.

Moreover, the period λ may be set as follows.

(a) In case of the condition A, the period λ ranges from $0.9\lambda_0$ to $1.1\lambda_0$.

(b) In case of the condition B, the period λ ranges from $(0.9\lambda_0+0.1r_t)$ to $(1.1\lambda_0-0.1r_t)$.

In such a range, the in-plane color difference ΔE can be controlled to 3 or less.

The structure in which the convex structures having different periods are mixed within the permissible range is also included in the convex structure according to the present embodiment.

(Method for Forming Convex Structure)

The convex structure on the roller 221 can be formed by an optical nanoimprint method using photo-curable resin, a thermal nanoimprint method using thermoplastic resin, and a laser edging method which performs edging by scanning laser.

Figure 14:
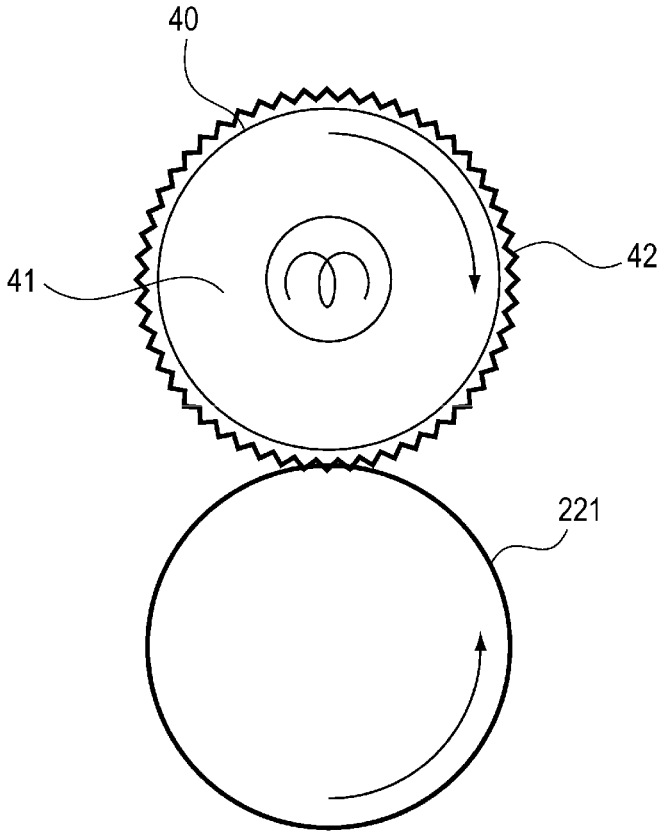
FIG. 14 is a schematic view illustrating an example of a method for forming a convex structure on the roller.

FIG. 14 is a schematic view illustrating an example of a method for forming a convex structure on the roller 221.

In this example, the method in which the convex structure on the roller 221 is formed through the thermal nanoimprint method will be described.

A film mold 42 having a concave structure corresponding to the reversed structure of the desired convex structure is fixed on a transfer roller 40 containing a halogen heater 41. Next, the roller 221 is pressed while brought in contact with the film mold 42. While the transfer roller 40 and the roller 221 are rotated at the same velocity, the roller 221 is heated at a temperature within the range of a melting point from the glass transition temperature by the halogen heater 41. Then, a convex structure is formed on the roller 221.

At this time, as illustrated in FIG. 14, the convex structure may be directly formed in the elastic layer 221*a* of the roller 221, or the elastic layer 221*a* may be previously coated with thermal plastic resin and the convex structure may be formed in the thermal plastic resin.

The optical nanoimprint method coats the surface of the roller 221 with photo-curable resin, and cures the photo-curable resin by irradiating UV using a UV light source installed in place of the halogen heater 41, thereby forming a convex structure.

Figure 15:
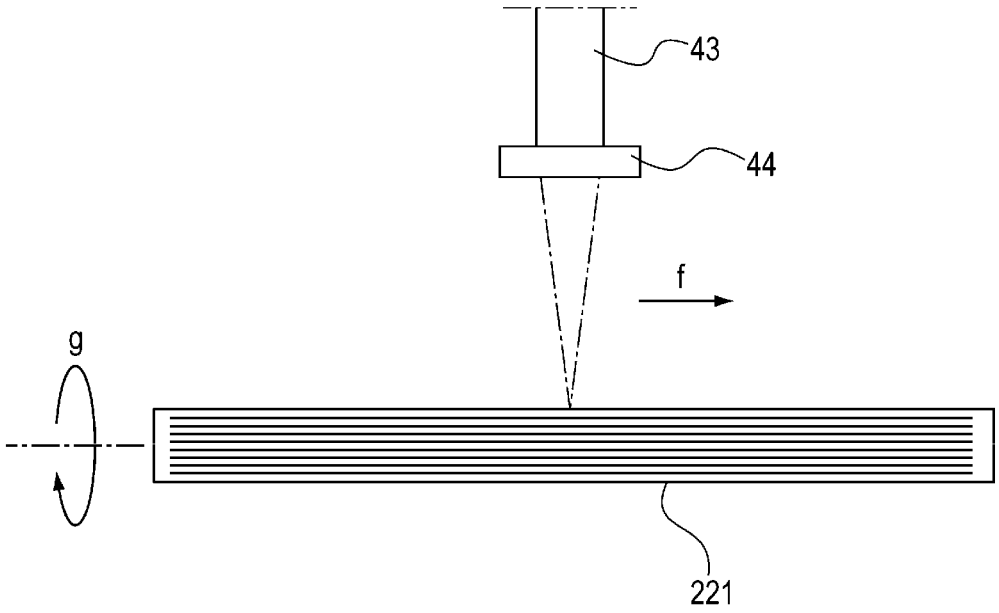
FIG. 15 is a schematic view illustrating another example of a method for forming a convex structure on the roller.

FIG. 15 is a schematic view illustrating another example of a method for forming a convex structure on the roller 221.

In this example, the convex structure on the roller 221 is formed through the laser nanoimprint method.

As laser 43 condensed through a condensing lens 44 is scanned onto the roller 221 in the direction of an arrow f, a convex structure is formed on the surface of the roller 221. Then, the roller 221 is slightly rotated in the direction of an arrow g, and laser is scanned again to form a convex structure. Such an operation is repeated to form the convex structure on the circumferential surface of the roller 221 along the axial direction thereof.

(Method for Measuring Convex Structure)

The convex structure on the roller 221 is measured through AFM (Nano-I made by Pacific Nanotechnology Inc.). The measurement is performed according to the operating manual of the measurement device. At this time, a sample is formed in a flat sheet shape by cutting out the surface of the roller 221 through a cutter or laser.

Figure 16:
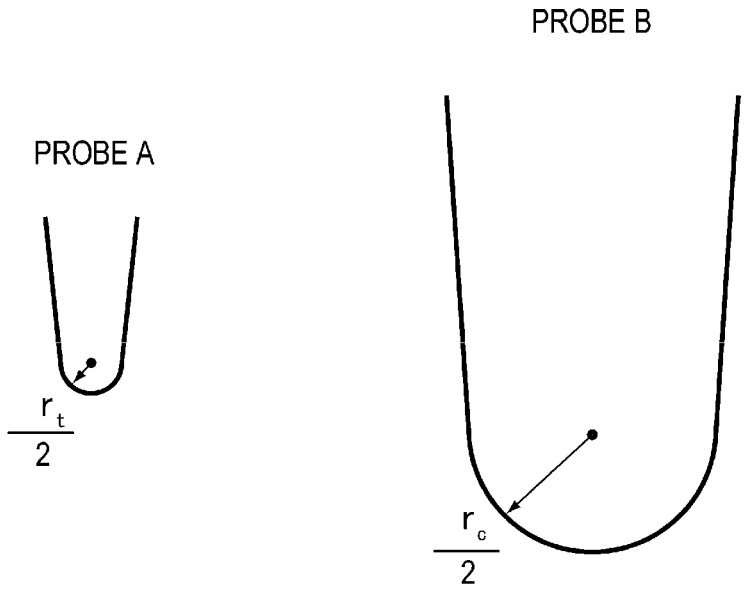
FIG. 16 is a schematic view illustrating the shapes of the leading ends (probes) of two kinds of cantilevers used in the present measurement.

FIG. 16 is a schematic view illustrating the shapes of the leading ends (probes) of two kinds of cantilevers used in the present measurement.

The probe A is a hemispherical probe of which the leading end has a toner particle diameter $r_t$, and the probe B is a hemispherical probe of which the leading end has a carrier particle diameter $r_c$.

A specific measurement method will be described. First, the probe B is used to measure the shape (x, y, $z_B$) of the surface of the toner supply member. This shape indicates the surface shape of the roller 221, with which a magnetic carrier having a particle diameter $r_c$ can come in contact, and is set to a reference surface. Subsequently, the probe A is used to measure the shape (x, y, $z_A$) of the surface of the toner supply member at the same position in the same manner. This shape indicates the surface shape of the toner supply member, with which a toner having the particle diameter $r_t$ can come in contact. A difference $|z_B-z_A|$ between the measured shapes in the height direction, that is, a height D from the reference surface is measured, and a coordinate (x, y) at which $r_{t10}/2 \leq D = |_B - z_A| \leq r_t$ is established is extracted. In consideration of the shape of the probe, circles having a diameter $r_t$ and centered at the coordinate are applied to the extracted coordinate, in order to perform image processing.

Figure 17:
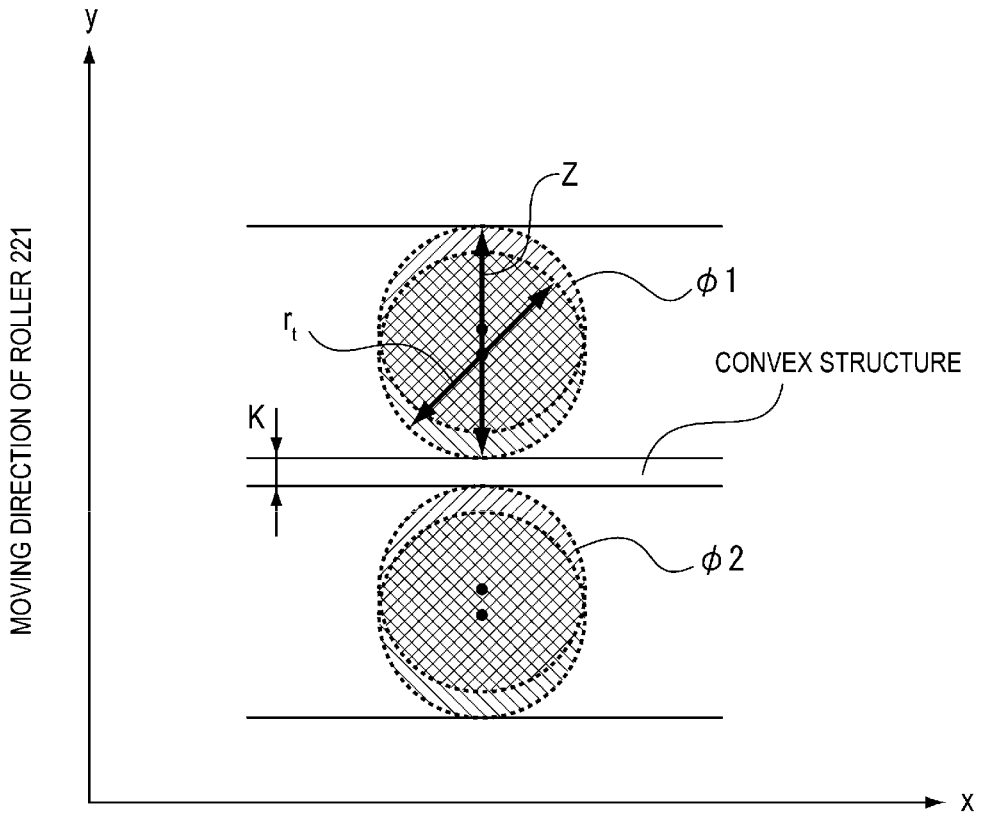
FIG. 17 is a diagram illustrating a result obtained by measurement and image processing when a probe is scanned along the y-axis in case where the moving direction of the surface of the roller is set to the y-axis.

FIG. 17 is a diagram illustrating a result obtained by measurement and image processing when the probe is scanned along the y-axis in case where the moving direction of the surface of the roller 221 is set to the y-axis.

For the extracted coordinate, a region Φ in which circles centered at the coordinate and having a diameter $r_t$ are superimposed and an opening width Z corresponding to the long diameter of the region Φ are obtained. Moreover, since the adjacent regions Φ1 and Φ2 forms the convex structure according to the present embodiment, the width K corresponding to the minimum distance therebetween is obtained. The convex structure according to the present embodiment is a structure obtained by the measurement and image processing. That is, a structure having a short period, which the probe A cannot enter, or a structure having a long period, which the probe B can enter, has no influence on the problem of the present invention. Such a structure may be included in the surface of the roller 221. In reality, even an imperfect convex structure which is partially broken in a minute region may be considered as the convex structure according to the present embodiment, when the imperfect convex structure can be determined to be a convex structure through measurement.

(Method for Measuring Particle Size Distribution)

A particle size distribution of toners is measured through Coulter Multisizer III (made by Beckman Coulter Inc.). The measurement is performed according to the operating manual of the measurement device. Specifically, 0.1 g of surface acting agent is added as a disperser to 100 ml of electrolyte (ISOTON), and 5 mg of measurement sample (toner) is further added to the electrolyte. The electrolyte having the sample suspended therein is dispersed in an ultrasonic dispersion device for two minutes, and set to a measurement sample.

An aperture is set to 100 μm, and a median diameter d50 is calculated by measuring the number of samples for each channel, and set to the number average particle diameter $r_t$ of the sample.

A particle size distribution of magnetic carriers is measured through a laser diffraction particle size distribution measurement device (SALD-3000 made by Shimadzu Corporation). The measurement is performed according to the operating manual of the measurement device. Specifically, 0.1 g of magnetic carrier is introduced into the device to perform measurement, and a median diameter d50 is calculated by measuring the number of samples for each channel, and set to the number average particle diameter $r_c$ of the sample.

(Method for Measuring Charging Series)

Only magnetic carriers are put into the developing container 21 of the developing device 20, and a rotation operation in typical development is performed for about one minute. At this time, the voltage application portion is removed, and the toner bearing member 22 and the developer collection member 23 are placed in an electrically floating state. At the position of the developing portion T, a probe of a surface electrometer (MODEL 347 made by Trek Inc.) is installed to face the toner bearing member 22, and measures the surface potential of the toner bearing member 22. A potential difference before and after a rotation operation (potential after operation—potential before operation) in development is measured. When the potential difference has a positive value, the roller 221 of the toner bearing member 22 may be determined to be in the positive side of the charging series in comparison to the magnetic carrier. On the other hand, when the potential difference has a negative value, the roller 221 of the toner bearing member 22 may be determined to be in the negative side of the charging series.

According to friction charging between the magnetic carrier and the toner, it is possible to determine whether the toner is in the positive side or the negative side of the charging series in comparison to the magnetic carrier, which makes it possible to determine a relative charging series among the three.

(Development Evaluation Method)

Development Amount

A toner related to development is introduced onto the photoreceptor 1, and the weight (mg) of the toner and the area ($cm^2$) of the introduced toner are measured, and a weight per unit area ($mg/cm^2$ is s calculated as a quotient obtained by dividing the weight by the area.

Toner Coverage

A toner coverage is calculated from an image obtained by photographing the photoreceptor 1 on which a toner image is developed, through a microscope (VHX-5000 made by Keyence Corp.). Only the area px of the toner portion is extracted from the photographed image using image processing software (Photoshop made by Adobe), and a ratio of the area px to the entire area is calculated as the coverage.

Density Evaluation after Fixing

A density evaluation after fixing is a result obtained by the following process. The toner bearing member 22 is covered with a toner, development and transfer are sequentially performed to fix a toner image on a coated sheet, and the density evaluation is performed. The density evaluation is performed by measuring a reflection density Dr on the coated sheet through a reflection densitometer (500 series made by X-Rite Inc.). When the measured reflection density Dr does not reach a desired reflection density (CMY:Dr≥1.3 and K:Dr≥1.5), the density evaluation is represented by X, and when the measurement reflection density Dr reaches the desired reflecting density, the density evaluation is represented by ○.

Image Uniformity Evaluation after Fixing

An image uniformity evaluation is performed for a halftone image (lightness L*≈70) in which density unevenness easily stands out conspicuously, according to the following evaluation standard.

Satisfactory level (○): density unevenness in a dotted state hardly stands out (0 to 3 points/$cm^2$).

Poor level (x): density unevenness in a dotted state stands out conspicuously (four points/$cm^2$).

Second Embodiment

Figure 18:
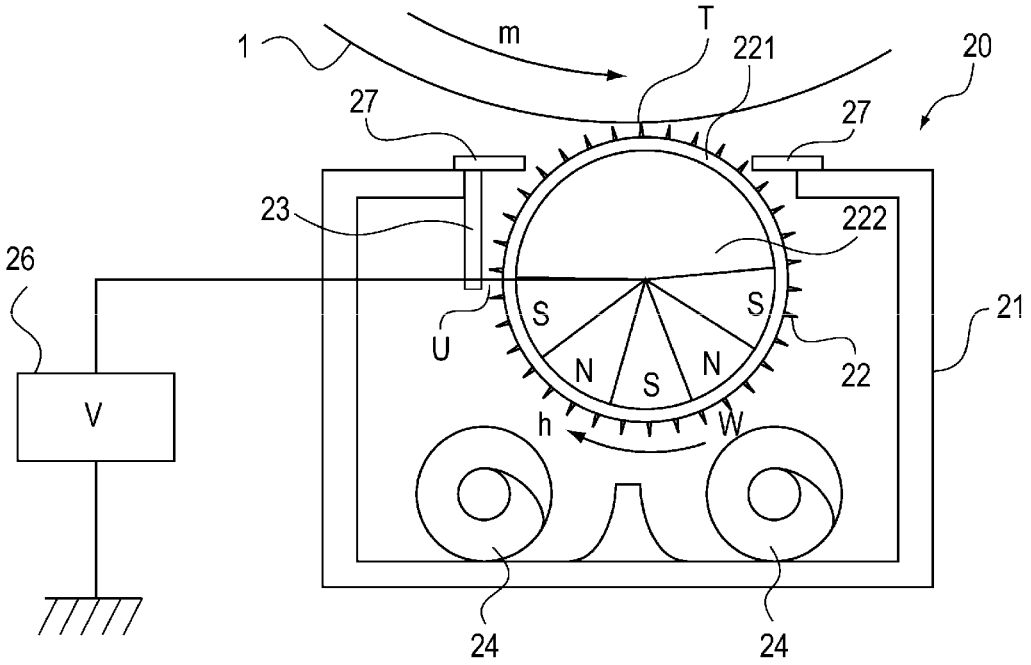
FIG. 18 is a schematic view of a developing device according to another embodiment of the present invention.

FIG. 18 is a schematic view of a developing device according to another embodiment of the present invention.

(Configuration of Developing Device)

A roller 221 of a toner bearing member 22 has a convex structure on which a plurality of convex portions 221*c* is regularly arranged in an arrow direction h of FIG. 18, which corresponds to the rotational direction of the roller 221. The convex portion 221*c* has a height equal to or less than a toner particle diameter. An opening width between the adjacent convex portions 221*c* is equal to or more than the toner particle diameter and less than a carrier particle diameter.

Figure 19:
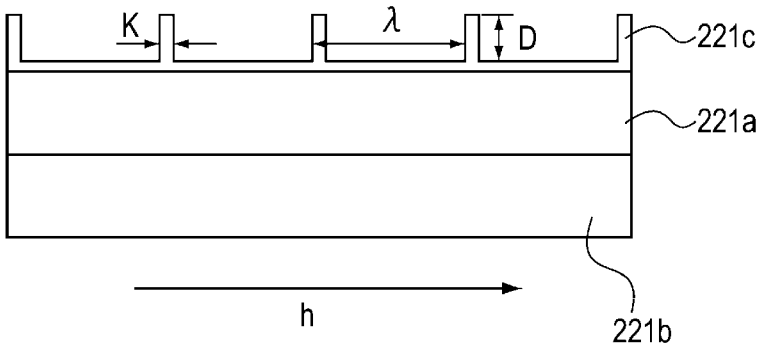
FIG. 19 is a cross-sectional view of a roller used in the embodiment of the present invention.

FIG. 19 is a cross-sectional view of the roller 221 used in the present embodiment.

The roller 221 includes a base layer 221*b* made of stainless steel, an elastic layer 221*a* disposed on the base layer 221*b*, and the plurality of convex portions 221*c* disposed on the elastic layer 221*a*. The elastic layer 221*a* is formed of silicone rubber in which carbon is dispersed and has a thickness of about 3 mm. The plurality of convex portions 221*c* is formed of a photo-curable resin layer having a thickness of 5 μm. The convex structure in the photo-curable resin layer is formed in the same shape as the first embodiment by the above-described convex structure formation method (optical nanoimprint method). In order to increase adhesion between the elastic layer 221*a* and the convex portions 221*c* of the photo-curable resin layer, a primer layer having a thickness of several nm may be formed therebetween.

Inside a developing container 21, a developer supply member 24 and a developer collection member 23 are arranged to face a toner bearing member 22, with an interval provided therebetween. The developer supply member 24 supplies a developer to the toner bearing member 22, and the developer collection member 23 collects a developer on the toner bearing member 22. The developer supply member 24 stirs the developer collected by the developer collection member 23 described later, carries the developer to a supply portion W at which the toner bearing member 22 and the developer supply member 24 face each other, and supplies the developer using a magnetic force generated by a permanent magnet 222.

The developer collection member 23 is formed of a magnetic material or a metallic material having high magnetic permeability, and collects the developer using a magnetic force generated by a magnetic field formed in cooperation with the permanent magnet 222. The developer collection member 23 is disposed at a position in the upstream of the developing portion T and the downstream of the supply portion W, in the moving direction of the toner bearing member 22. The toner bearing member 22 is disposed to come in contact with the photoreceptor 1 at the developing portion T, and includes an anti-scattering sheet 27 provided at the opening of the developing container, in order to prevent the toner from scattering to the outside of the development device.

(Detailed Descriptions for Toner Covering and Development of Electrostatic Image)

Next, a toner covering onto the toner bearing member 22 and development of an electrostatic image of the photoreceptor 1 will be described.

Figure 20:
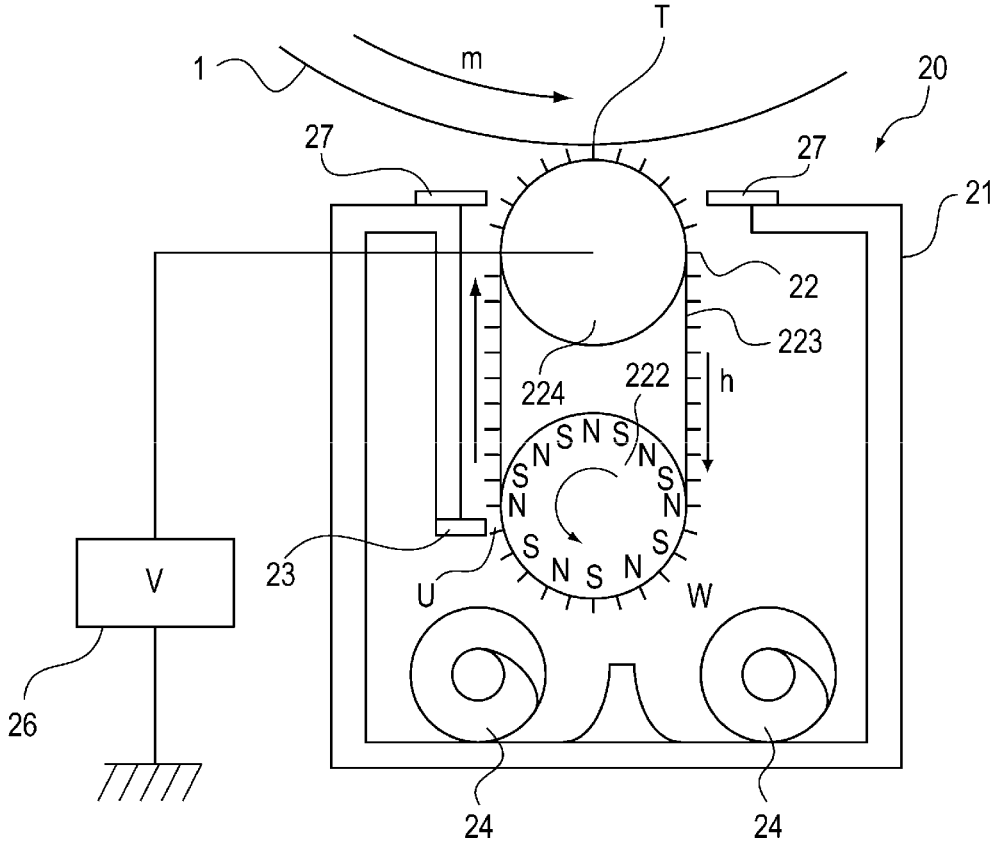
FIG. 20 is a schematic view of a developing device according to another embodiment of the present invention.

At the supply portion W, the developer supplied to the toner bearing member 22 by the developer supply member 24 is carried in an arrow direction h of FIG. 20 by the rotation of the roller 221 (direction h of FIG. 20) and the magnetic force generated through the magnetic field formed by the permanent magnet 222. The carried developer is restrained at the collection portion U, at which the developer collection member 23 and the toner bearing member 22 face each other, by a magnetic force generated through the magnetic field formed in cooperation between the developer collection member 23 and the permanent magnet 222, and finally drops into the developing container 21 due to the gravity.

The toner which comes in contact with the roller 221 and covers the roller 221 is passed through the collection portion U and carried to the developing portion T facing the photoreceptor 1, in order not to be restrained by the magnetic force.

As the voltage application portion 26 applies a voltage to the toner bearing member 22, a potential difference occurs between the toner bearing member 22 and the photoreceptor 1. The moving velocity ratio $v_{22}/v_1$ of the toner bearing member 22 to the moving velocity $v_1$ of the photoreceptor 1 is set so as to satisfy Equation 5 or 6.

Then, although a small toner amount is used, high-density development can be stably performed on the photoreceptor 1. While a desired density is obtained, density unevenness can be improved.

In the developing device according to the present embodiment, the developer collection member has a simple structure, thereby contributing to reducing the size of the developing device.

Third Embodiment

FIG. 20 is a schematic view of a developing device according to another embodiment of the present invention.

(Configuration of Developing Device)

A toner bearing member 22 includes a toner carrying belt 223 which can be rotated in the arrow direction h of FIG. 20 and two or more driving rollers 224 and 225 for driving the toner carrying belt 223. As one of these two driving rollers, the driving roller 224 adjacent to the photoreceptor 1 includes a structure formed by covering a base layer with an elastic layer. The base layer is a cylindrical member formed of a metallic material. As the other rollers, driving roller 225 has a rotatable permanent magnet 222 formed therein, a magnetic member is arranged in the rotating toner bearing member 22.

As described above, the toner carrying belt 223 is stretched between the two rollers, and has a belt shape which can circulate between the two rollers.

The toner carrying belt 223 has a convex structure on which a plurality of convex portions 221*c* is regularly arranged in a moving direction h thereof. The convex portion 221*c* has a height equal to or less than a toner particle diameter. An opening width between the adjacent convex portions 221*c* is equal to or more than the toner particle diameter and less than a carrier particle diameter.

In the present embodiment, the belt-shaped member formed of polyimide is used as the roller 221, and the convex structure having the same shape as the first embodiment is formed by the thermal nanoimprint method for the belt member.

Inside a developing container 21, a developer supply member 24 and a developer collection member 23 are fixed and arranged to face the driving roller 225, with an interval provided therebetween. The developer supply member 24 supplies a developer to the toner bearing member 22, and the developer collection member 23 collects a developer on the toner bearing member 22. The developer supply member 24 stirs the developer collected by the developer collection member 23 to be described below, carries the developer to a supply portion W at which the toner bearing member 22 and the developer supply member 24 face each other, and supplies the developer using a magnetic force generated by a permanent magnet 222.

The developer collection member 23 is formed of a metallic material having high magnetic permeability, and collects developer using a magnetic force generated by the magnetic field formed in cooperation with the permanent magnet 222. The developer collection member 23 is disposed at a position in the upstream of the developing portion T and the downstream of the supply portion W, in the moving direction h of the toner bearing member 22.

The toner bearing member 22 is disposed to come in contact with the photoreceptor 1 at the developing portion T, and includes an anti-scattering sheet 27 provided at the opening of the developing container, in order to prevent the toner from scattering to the outside of the development device.

(Detailed Description for Toner Covering and Development of Electrostatic Image)

Next, a toner covering onto the toner bearing member 22 and development of an electrostatic image of the photoreceptor 1 will be described.

At the supply portion W, the developer supplied to the toner bearing member 22 by the developer supply member 24 is carried in the direction h of the toner carrying belt 223 by a magnetic force generated through the magnetic field formed by the movement of the toner carrying belt 223 in the direction h and the movement of the permanent magnet 222 in the direction p. The carried developer is restrained at the collection portion U, at which the developer collection member 23 and the driving roller 225 face each other, by the magnetic force generated through the magnetic field formed in cooperation between the developer collection member 23 and the permanent magnet 222, and finally drops into the developing container 21 due to the gravity.

The toner which comes in contact with the toner carrying belt 223 and covers the toner carrying belt 223 is passed through the collection portion U and carried to the developing portion T at which the photoreceptor 1 and the driving roller 224 face each other, in order not to be retrained by the magnetic force.

As the voltage application portion 26 applies a voltage to the toner bearing member 22, a potential difference occurs between the toner bearing member 22 and the photoreceptor 1. The moving velocity ratio $v_{22}/v_1$ of the toner bearing member 22 to the moving velocity $v_1$ of the photoreceptor 1 is set so as to satisfy Equation 5 or 6.

Then, although a small toner amount is used, high-density development can be stably performed on the photoreceptor 1. While a desired density is obtained, image uniformity can be improved.

In the developing device according to the present embodiment, as the permanent magnet 222 arranged in the driving roller 225 is rotated and carried such that the magnetic brush is rotated to reverse the upper end/lower end of the toner carrying belt 223. Thus, the contact frequency between the toner carrying belt 223 and the toner can be increased at a short carrying distance and for a short time. Furthermore, the rotation velocity of the permanent magnet 222 may be controlled to adjust the toner amount related to covering without having influence on other components.

Fourth Embodiment

Figure 21:
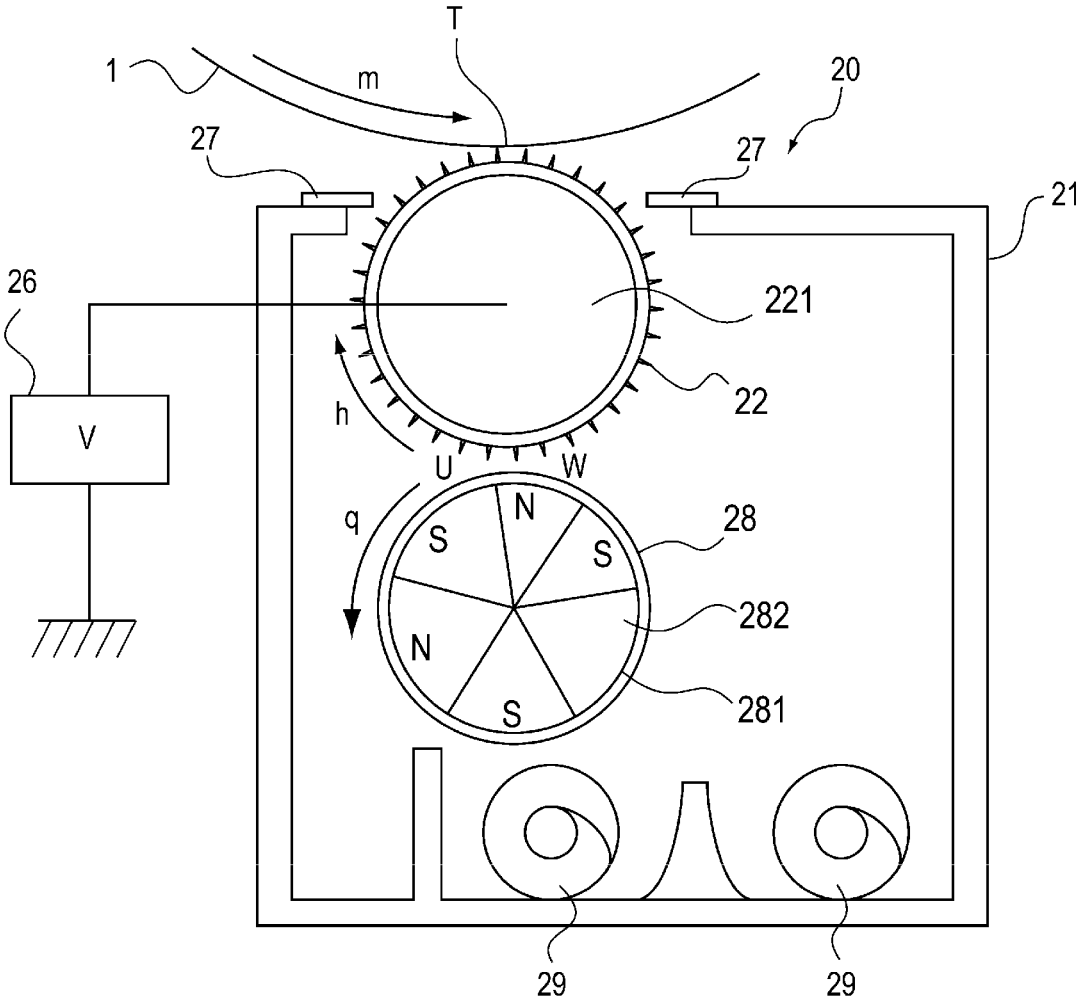
FIG. 21 is a schematic view of a developing device according to another embodiment of the present invention.
Figure 22:
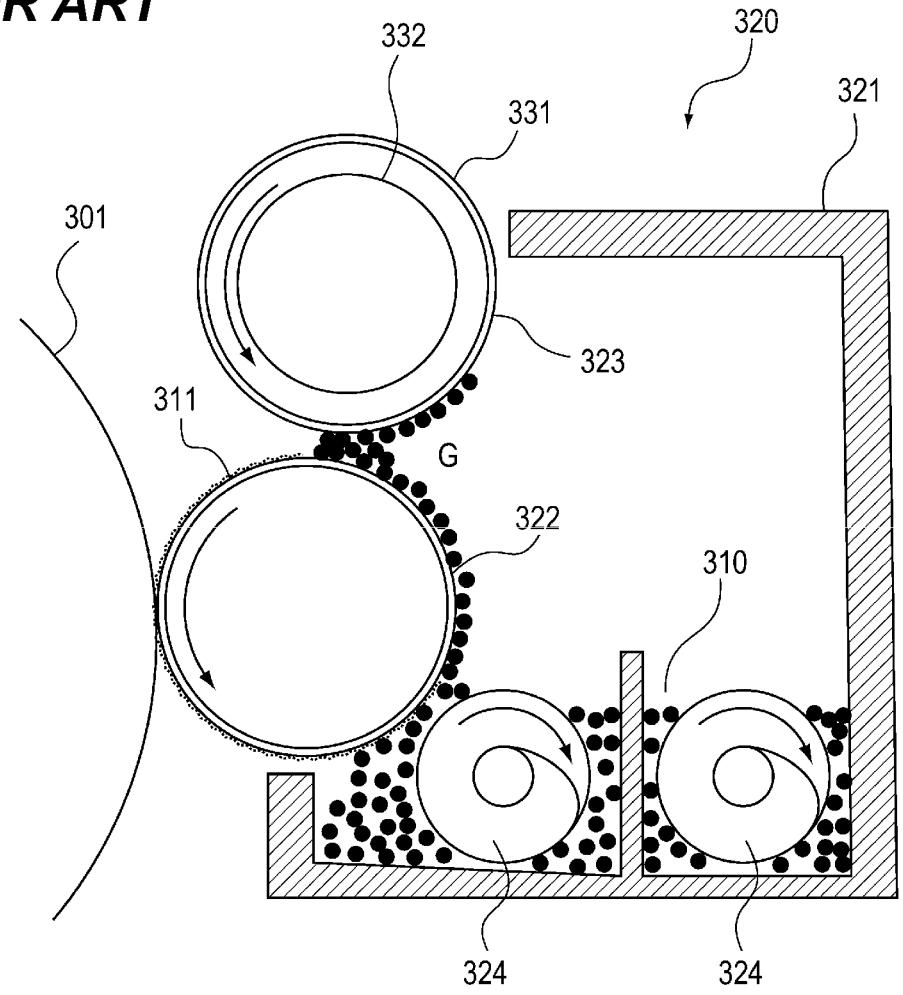
FIG. 22 PRIOR ART
FIG. 22 is a diagram illustrating a developing device according to the related art.
Figure 23:
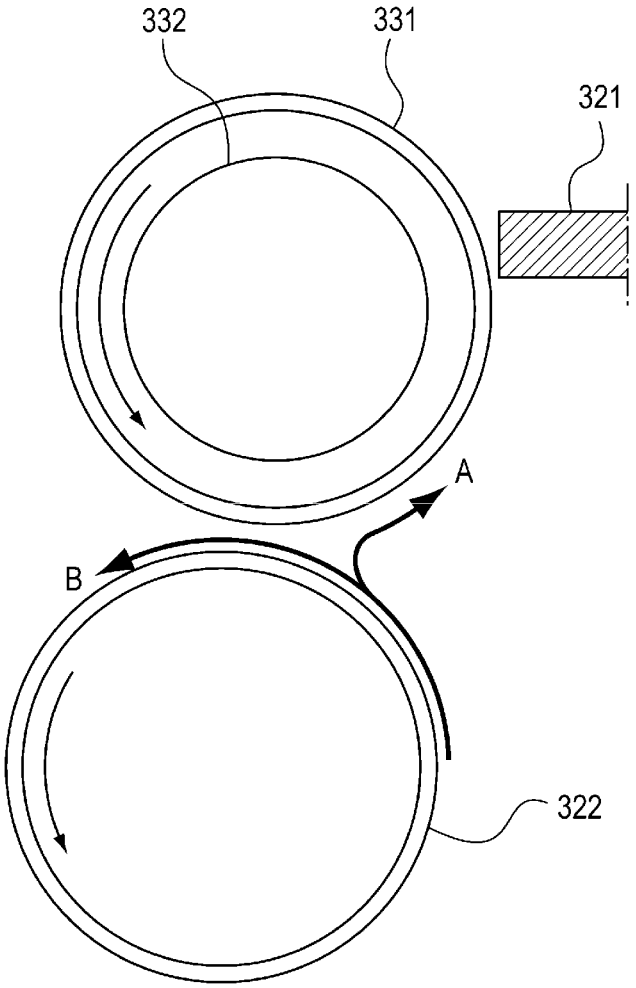
FIG. 23 PRIOR ART
FIG. 23 is an enlarged view of a developer regulation region G.
Figure 24:
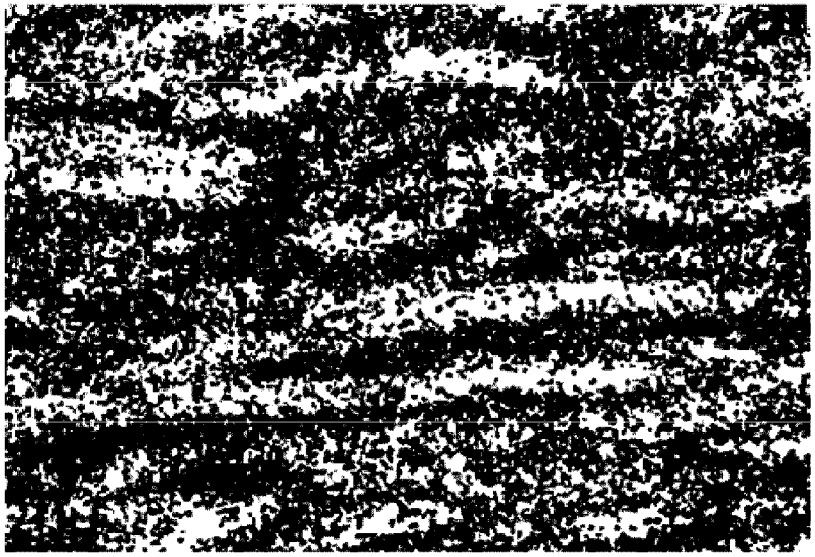
FIG. 24 is a conceptual view of a toner layer which is obtained by the developing device to the related art so as to cover a developing roller.
Figure 25A:
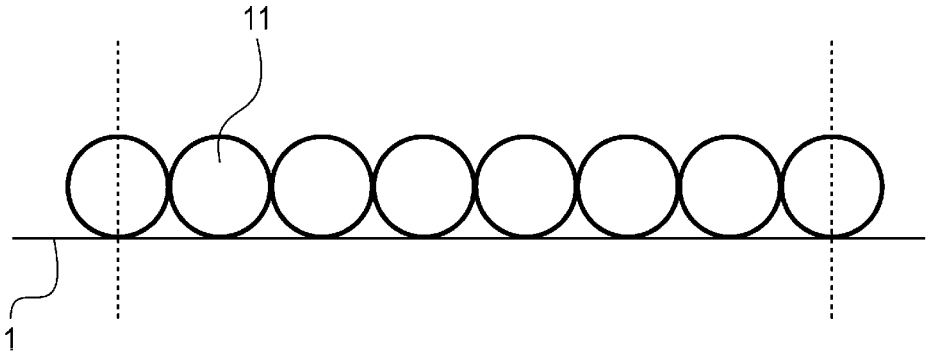
FIGS. 25A and 25B are schematic views illustrating a case in which an electrostatic image on the photoreceptor is developed through a toner, FIG. 25A illustrating a case in which the electrostatic image is ideally developed, and FIG. 25B illustrating a case in which the electrostatic image is developed by adjusting the circumferential velocity of the developing roller and the photoreceptor.
Figure 25B:
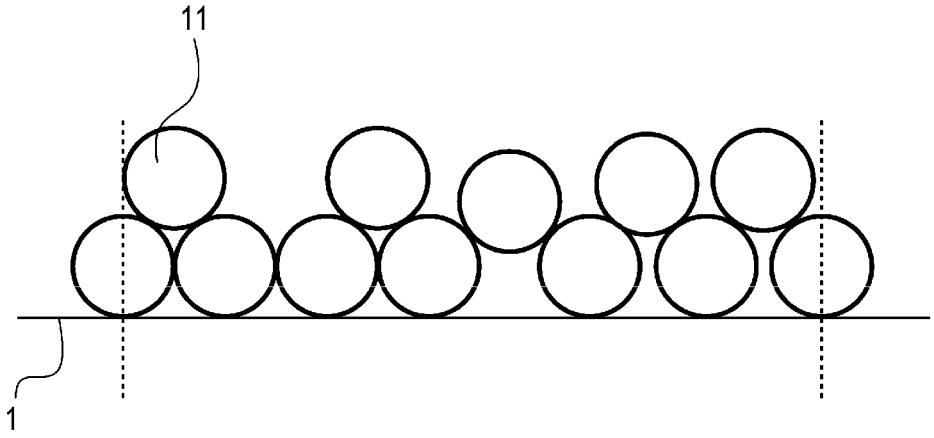
Figure 26:
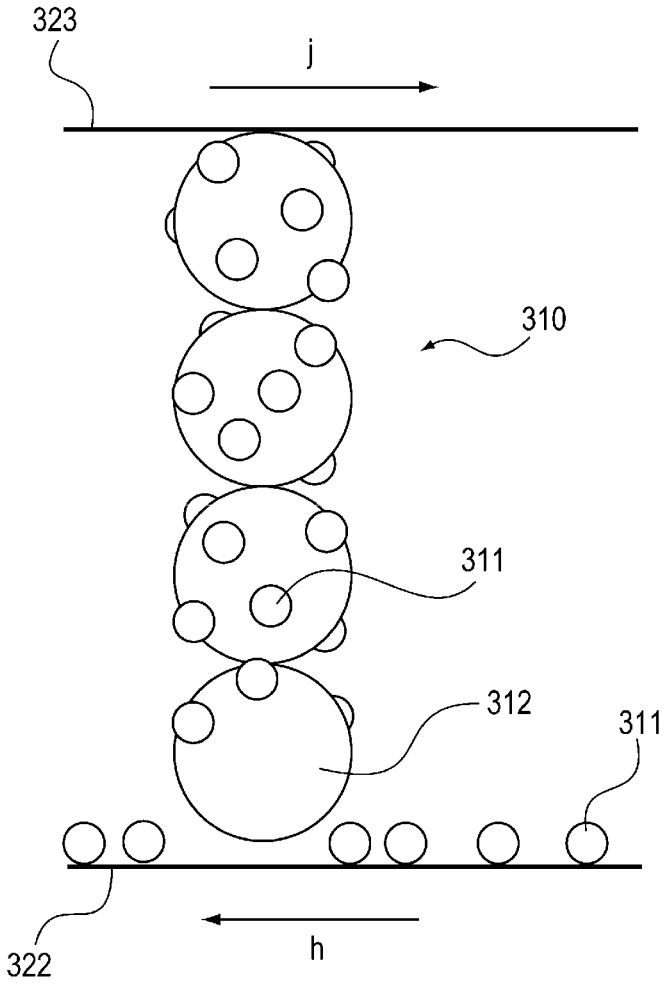
FIG. 26 is a diagram for describing an examined model.
Figure 27A:
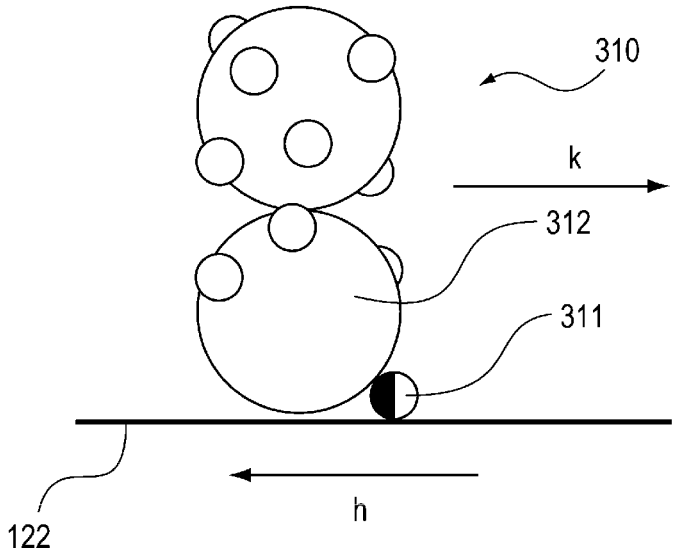
FIGS. 27A and 27B are schematic views illustrating that the toner adhering to the developing roller is collected by the magnetic carrier of the developer.
Figure 27B:
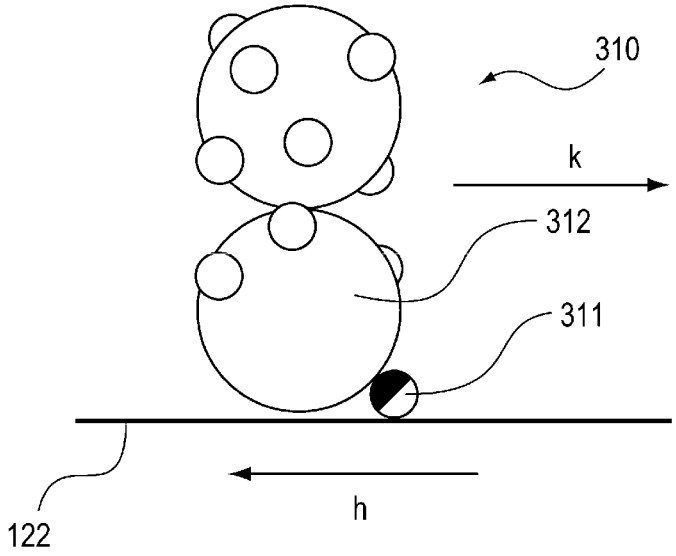

FIG. 21 is a schematic view of a developing device according to another embodiment of the present invention.

(Configuration of Developing Device)

A toner bearing member 22 includes a roller 221 which can be rotated in a direction h of FIG. 21. The roller 221 is formed by covering a base layer 221*b* with an elastic layer 221*a*. The base layer 221*b* is a cylindrical member formed of a metallic material. The roller 221 has a convex structure on which a plurality of convex portions 221*c* is regularly arranged, in the moving direction thereof. The convex portion 221*c* has a height equal to or less than a toner particle diameter. An opening width between the adjacent convex portions 221*c* is equal to or more than the toner particle diameter and less than a carrier particle diameter. The convex structure has the same shape as the first embodiment.

In the present embodiment, the convex structure is directly formed on the elastic layer 221*a* of the roller 221, like the first embodiment. However, a structural resin layer may be provided on the elastic layer 221*a*, and the convex structure may be formed in the resin layer like the first embodiment.

Inside a developing container 21, a developer supply/collection member 28 is arranged to face the toner bearing member 22, with an interval provided therebetween. The developer supply/collection member 28 is a developer collection member which can collect a developer from the toner bearing member 22, and supply a developer to the toner bearing member 22. The interval is adjusted so that the developer carried on the developer supply/collection member 28 comes in contact with the toner bearing member 22. The developer supply/collection member 28 includes a rotatable roller 281 and a permanent magnet 282 fixed and arranged therein.

The developing container 21 includes a stirring/supply member 29 provided therein. The stirring/supply member 29 stirs the developer and supplies the stirred developer to the developer supply/collection member 28.

The toner bearing member 22 is disposed to come in contact with the photoreceptor 1 at the developing portion T, and includes an anti-scattering sheet 27 provided at the opening of the developing container, in order to prevent the toner from scattering to the outside of the development device.

(Detailed Description of Toner Covering and Development of Electrostatic Image)

Next, a toner covering onto the toner bearing member 22 and development of an electrostatic image of the photoreceptor 1 will be described.

The developer supplied to the developer supply/collection member 28 by the stirring/supply member 29 is carried in the rotational direction of the roller 281 (arrow direction q of FIG. 21) by the magnetic force generated through the rotation of the roller 281 and the magnetic field formed by the permanent magnet 282. The carried developer is supplied to the toner bearing member 22 by coming in contact with the toner bearing member 22 at the supply portion W, and collected by the developer supply/collection member 28 at the collection portion U by the magnetic force generated through the magnetic field formed by the permanent magnet 282.

The toner which comes in contact with the roller 221 and covers the roller 221 is passed through the collection portion U and carried to the developing portion T at which the photoreceptor 1 and the roller 221 face each other, in order not to be restrained by the magnetic force.

As the voltage application portion 26 applies a voltage to the toner bearing member 22, a potential difference occurs between the toner bearing member 22 and the photoreceptor 1. The moving velocity ratio $v_{22}/v_1$ of the toner bearing member 22 to the moving velocity $v_1$ of photoreceptor 1 is set to satisfy Equation 5 or 6.

Then, although a small toner amount is used, high-density development can be stably performed on the photoreceptor 1. While a desired density is obtained, image uniformity can be improved.

In the present embodiment, as no voltage is applied to the developer supply/collection member 28, the developer supply/collection member 28 is placed in an electrically floating state. However, a voltage may be applied to the developer supply/collection member 28 such that the developer supply/collection member 28 is equipotential to the toner bearing member 22.

In the developing device according to the present embodiment, the developer supply/collection member performs the roles of the developer supply member and the developer collection member. Thus, the developer does not need to be carried between the members, and a carrying fail such as an immobile layer hardly occurs while the developer is carried. Therefore, a shearing force is hardly applied to the developer, and the deterioration of durability can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-024650, filed Feb. 12, 2014, which is hereby incorporated by reference herein in its entirety.

What is claimed is:

1. A developing device configured to develop an electrostatic image formed on an image bearing member by a developer containing non-magnetic toner particles and magnetic carrier particles, comprising:

a developing member configured to develop the electrostatic image formed on the image bearing member at a developing position, the developing member carrying developer from a supplying position for supplying developer to a collecting position for collecting the magnetic carrier particles to carry the toner particles to the developing position from the collecting position; and a carrier recovering member configured to recover the magnetic carrier particles from the developing member at the collecting position, the carrier recovering member having a magnet to form a magnetic field between the magnet and the developing member for collecting the magnetic carrier particles from the developing member;

wherein an outer surface of the developing member includes a plurality of protrusion portions which extend along the outer surface of the developing member in a direction intersecting a toner particle carrying direction of the developing member and are aligned with a regular interval between adjacent protrusion portions, wherein the regular interval is equal to or larger than a particle diameter of a toner particle having an average particle diameter from among the particle diameters of the toner particles and smaller than a carrier particle diameter of a magnetic carrier particle having an average particle diameter from among the particle diameters of the magnetic carrier particles, and wherein the protrusion portions protrude from the outer surface of the developing member with a height that is smaller than the average particle diameter of the toner particles, and wherein the developing member contacts with the image bearing member at a developing portion, and the developing member and the image bearing member rotate so as to have a relative velocity difference at the developing portion.

2. The developing device according to claim 1, wherein when a moving velocity of a surface of the developing member is set to $v_{22}$(mm/s), a moving velocity of a surface of the image bearing member is set to $v_1$(mm/s), an average diameter of the toner is set to $r_t$(μm), an average diameter of the carrier is set to $r_c$(μm), the regular interval in the developer carrying direction is set to Z(μm), and a period of an interval between the plurality of protrusion portions is λ(μm), a relation of $v_{22}/v_1 \geq \lambda/r_t$ is established in case of $r_t \leq Z < 2r_t$, and a relation of $v_{22}/v_1 \geq (\lambda - r_t)/r_t$ is established in case of $2r_t \leq Z < r_C$.

3. The developing device according to claim 1, wherein the regular interval is smaller than three times the particle diameter of the toner particles.

4. The developing device according to claim 1, wherein when particle diameters of which cumulative number distribution is 10% in a toner particle size distribution of the toner particles are set to $r_{t10}$ (μm), particle diameters of which cumulative number distribution is 90% are set to $r_{t90}$ (μm), and a height of the protrusion portion is set to D (μm), a relation of $r_{t10}/2 \leq D \leq r_{t90}/2$ is established.

5. The developing device according to claim 1, wherein a charging series of a surface of the developing member, the toner particle, and the magnetic carrier particles are set so that the magnetic carrier particles are positioned between the toner particles and the surface of the developing member.

6. The developing device according to claim 1, wherein the carrier recovering member comprises a rotatable roller and a magnetic material or metallic material fixed and arranged in the roller.

7. The developing device according to claim 1, further comprising a developer supply member which supplies the developer to the developing member, wherein the carrier recovering member comprises a magnetic material fixed and arranged at a position facing the developing member and a metallic material having high magnetic permeability, and is arranged in an upstream direction of the developing portion and in a downstream direction of a developer supply portion which supplies the developer through the developer supply member, in a moving direction of the developing member.

8. The developing device according to claim 1, wherein the developing member is rotatable and has a magnetic member inside of the developing member, and the carrier recovering member has a metallic material fixed and arranged at a position facing the developing member.

9. The developing device according to claim 8, wherein the developing member has a belt shape stretched between a rotatable roller and the magnetic member and capable of circulating between the roller and the magnetic member, and carries the toner particles.

10. The developing device according to claim 1, wherein the carrier recovering member is configured to supply the developer to the developing member, and comprises a rotatable roller and a magnetic material arranged in the roller, and the developer carried by the roller is disposed to come in contact with the developing member and forms a magnetic force to supply and collect the developer, using the magnetic material.

11. The developing device according to claim 1, wherein the developing member is formed of a material having elasticity or flexibility, and is arranged to come in contact with the image bearing member.

12. An image forming apparatus for forming an electrostatic image in an image bearing member and forming an image by developing the electrostatic image using a developing device, the image forming apparatus comprising the developing device of claim 1 as the developing device.

* * * * *